US007814579B2

(12) United States Patent
Dion

(10) Patent No.: US 7,814,579 B2
(45) Date of Patent: Oct. 19, 2010

(54) MODULAR HELMET

(75) Inventor: Stephane Dion, St-Cecile de Milton (CA)

(73) Assignee: KBC America, Inc., Burbank, CA (US)

( * ) Notice: Subject to any disclaimer, the term of this patent is extended or adjusted under 35 U.S.C. 154(b) by 1348 days.

(21) Appl. No.: 11/223,140

(22) Filed: Sep. 12, 2005

(65) Prior Publication Data

US 2006/0064799 A1 Mar. 30, 2006

Related U.S. Application Data

(60) Provisional application No. 60/612,947, filed on Sep. 27, 2004.

(51) Int. Cl.
*A63B 71/10* (2006.01)

(52) U.S. Cl. ..... 2/425; 2/6.5; 2/410

(58) Field of Classification Search ..... 2/410, 2/6.5, 411, 417, 425, 424, 423
See application file for complete search history.

(56) References Cited

U.S. PATENT DOCUMENTS

| | | | | |
|---|---|---|---|---|
| 4,023,210 | A | 5/1977 | Hanson | |
| 4,581,776 | A | 4/1986 | Kie | |
| 5,093,939 | A | 3/1992 | Noyerie et al. | |
| 5,266,930 | A | 11/1993 | Ichikawa et al. | |
| 5,461,731 | A * | 10/1995 | Shida | 2/424 |
| 5,815,848 | A | 10/1998 | Jarvis | |
| 6,212,689 | B1 * | 4/2001 | Lee | 2/424 |
| 6,226,803 | B1 * | 5/2001 | Tanaka | 2/424 |
| 6,237,161 | B1 * | 5/2001 | Lee | 2/414 |
| 6,253,386 | B1 | 7/2001 | Gafforio | |
| 6,405,373 | B1 | 6/2002 | Grau | |
| 6,438,763 | B2 | 8/2002 | Guay et al. | |
| 6,598,238 | B2 * | 7/2003 | Hong et al. | 2/424 |
| 6,604,246 | B1 | 8/2003 | Obreja | |
| 6,622,313 | B1 | 9/2003 | Choi et al. | |
| 6,698,032 | B1 | 3/2004 | Robertson | |
| 6,718,559 | B1 | 4/2004 | Davidson | |
| 6,851,129 | B2 | 2/2005 | Gafforio et al. | |

(Continued)

OTHER PUBLICATIONS

Motorcycle Cruiser magazine comparison test of 7 Modular Flip-up motorcycle helmets (12 pages).

(Continued)

*Primary Examiner*—Shaun R Hurley
*Assistant Examiner*—Andrew W Sutton
(74) *Attorney, Agent, or Firm*—Miles & Stockbridge P.C.; David R. Schaffer, Esq.

(57) ABSTRACT

A helmet is disclosed that includes a hinged chin guard and a hinged visor. The chin guard and the visor can each be independently raised or they can be raised together. That is, they can be rotated up and from in front of the face of a wearer of the helmet. A one-button release mechanism is provided on the chin guard to release detents that secure the chin guard to the cap body. The chin guard can lock into place when raised or lowered. The chin guard is adapted to rotate in a substantially elliptical trajectory about the sides and top of the cap body. The visor can be rotated through a series of ratchet positions and be removed from the helmet without tools and without removing the chin guard.

26 Claims, 18 Drawing Sheets

U.S. PATENT DOCUMENTS

| | | | |
|---|---|---|---|
| 2002/0174480 | A1 | 11/2002 | Lombard |
| 2003/0028953 | A1 | 2/2003 | Acquaviva |
| 2003/0051289 | A1 | 3/2003 | Gafforio et al. |
| 2003/0088907 | A1 | 5/2003 | Gafforio et al. |
| 2004/0010832 | A1 | 1/2004 | Witkoff |
| 2004/0040073 | A1 | 3/2004 | Morrow et al. |
| 2004/0163161 | A1 | 8/2004 | Morrow et al. |
| 2005/0015855 | A1 | 1/2005 | Skiba |
| 2005/0015861 | A1 | 1/2005 | Gafforio et al. |
| 2005/0060793 | A1 | 3/2005 | Rosie |
| 2005/0120467 | A1 | 6/2005 | Desarmaux et al. |

OTHER PUBLICATIONS

Ski-doo Modular Helmet—Black Quinn's Marina Pefferlaw, Ontario (2 pages).

Ski-doo Factory Snowmobile Helmet, Quinn's Marina Pefferlaw, Ontario (1 page).

What's Inside & Outside a Motorcycle Helmet—Anatomy (3 pages).

MotorcycleBeginner.com by Plain Jim—Helmets (3 pages).

* cited by examiner

MODULAR HELMET

RELATED APPLICATIONS

This application claims the benefit under 35 U.S.C. §119 (e) to Provisional Application No. 60/612,947, filed Sep. 27, 2004, entitled "Modular Helmet" which is incorporated herein by reference in its entirety. This application is also related to Design Application No. 29/222,266, filed Jan. 28, 2005, and entitled "Modular Flip Up Helmet", which is incorporated herein by reference in its entirety.

FIELD OF THE INVENTION

The present invention relates in general to protective gear and in particular to a helmet worn in active sporting activities such as, for example, motorcycling and snowmobiling, to name a few.

BACKGROUND

Today, snowmobiling and motorcycling are more popular than ever. This increase in popularity has resulted in an increase in the number of participants. Unfortunately, increased participation has resulted in an increase in the number of injuries suffered by individuals, and particularly in the number of facial and head injuries. Consequently, the use of helmets when participating in such activities is highly recommended, if not required. A person engaged in an activity where a helmet is used may desire to have the protection of a chin guard and visor on the helmet in addition to the protection provided by an inner liner and a hard outer shell of a cap body of the helmet. The modular, or flip up, helmet was designed to meet these needs.

Conventional modular helmets may suffer from several limitations. They may not be wearable or easily usable while riding with the visor or chin guard raised. Second, in a helmet with a facial section including a moveable chin guard, the attachment point where the chin guard locks to the cap body of the helmet is susceptible to wear. Further, the chin guard locking mechanism may be deployed or activated in crash. Also, such helmets may be difficult to remove, particularly to a would-be rescuer at a crash scene. Finally, a rotating portion may not always fit flush to the cap body and may create some wind resistance and noise.

SUMMARY

The modular helmet of the present invention was conceived in light of the above-mentioned limitations of conventional helmets and it is an object of the present invention to minimize these limitations. In accordance with one feature of the invention, a hinge mechanism that allows the chin guard to rotate up and back and then lock into place. In accordance with another feature of the invention the hinge mechanism of the subject modular helmet permits the wearer to raise the facial section which includes the chin guard and visor, allowing him to eat, smoke, or simply remove a barrier for conversation without going through the rigmarole of unfastening and removing the helmet. In still another feature of the invention, the visor may be raised independently of the chin guard and the visor may be rotated through a series of ratchet positions selectively.

In another feature of the invention, metal lock plates are provided on the cap body and metal lock points are provided on the chin guard so as to allow the chin guard to lock to the cap body and provide greater wear resistance. In still a further feature of the invention, the chin guard hinge includes side wings which fit snuggly against the cap body when the chin guard is lowered, and a one-button release permits the chin guard to be unlocked with ease.

In an exemplary embodiment of the present invention, the modular helmet includes a hard outer shell cap body, a crushable inner liner, and a facial section including a flip-up chin guard and visor. The chin guard is attached to the cap body by a first pair of rotational hinges and the visor is attached to the chin guard by a second pair of rotational hinges. The chin guard and the visor can each be independently raised by rotating up and away from the face of a wearer of the helmet.

In another exemplary embodiment of the present invention, left and right chin guard hinges are located on each side of the helmet and allow the chin guard and visor to be raised and lowered together between a first fully open position and a second fully closed position. Each chin guard hinge comprises a fixed axis joint and a floating axis joint coupled by a swing arm that permits rotational movement and positioning of the chin guard. The chin guard is held in a raised position by force exerted by the swing arm in the floating axis joint that holds a cam in a first rotational position in a recessed and indented area. Also, a spring in the fixed axis joint of the chin guard hinge can provide force to help keep the chin guard in a raised position.

In another exemplary embodiment of the invention, the visor hinge comprises a first portion on the visor and a second portion on the chin guard. When assembled, the first portion of the visor hinge engages the second portion of the visor hinge to create a rotational hinge. Rotational hinges which are the mirror image of each other are located on each side of the helmet to allow the visor to be raised and lowered. The visor may be raised through a series of ratchet positions provided by a combination of detents on the visor and chin guard. A spring-loaded catch, when retracted, allows the visor to swivel up to a fully raised position at which point the visor is removable. The ratchet positions allow the visor to be selectively raised to a partial open position and fixed in that position.

In a further exemplary embodiment of the invention, a chin guard lock is provided for locking the chin guard to the cap body. Corresponding lock plates are provided on the cap body of the helmet. A chin guard button allows the wearer to release the chin guard from the locked position.

BRIEF DESCRIPTION OF THE DRAWINGS

The present invention will be described with reference to the accompanying drawings in which like reference characters represent like parts throughout the several views, and wherein.

DETAILED DESCRIPTION

The present invention is described in relation to exemplary embodiments shown in the figures. It should be appreciated, however, that the embodiments shown are exemplary and other configurations and arrangements of the present invention may be apparent to those of ordinary skill in the applicable arts.

Several of the figures give approximate values of angle of rotation. These values are for illustration purposes. Other rotational angles may be used.

The visor hinge is shown with numerous guides and detents, both on the first portion of the hinge and the chin guard of the hinge. It should be appreciated that the embodiments shown are exemplary.

The hinges for the chin guard and the visor may provide for separate and independent movement for each of the chin guard and the visor. While only one hinge may be illustrated, it should be appreciated that complementary hinges are provided on each side of the helmet.

Figure 1:
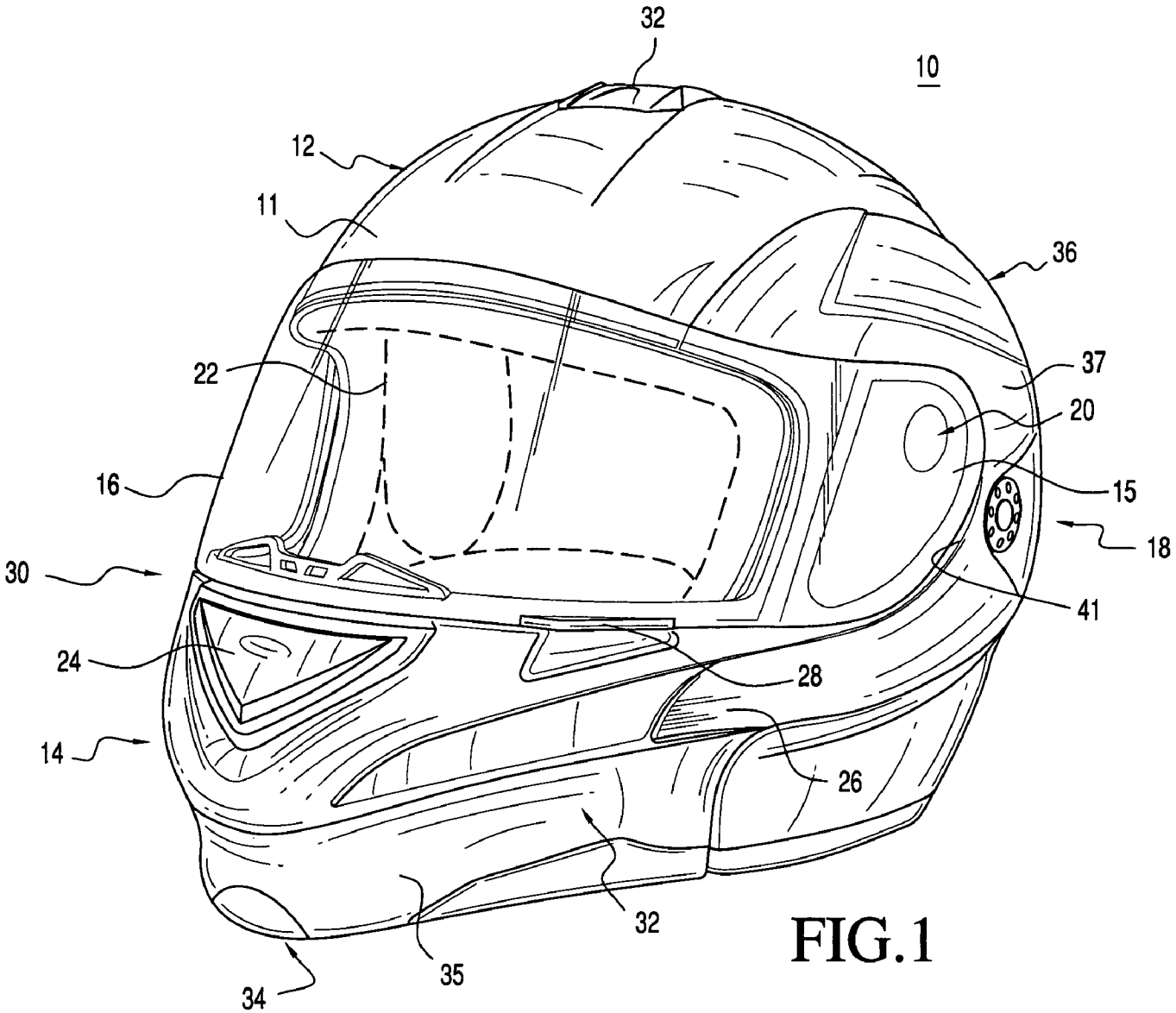
FIG. 1 is a perspective view of the exterior of an exemplary embodiment of a modular helmet in accordance with the present invention.
Figure 2:
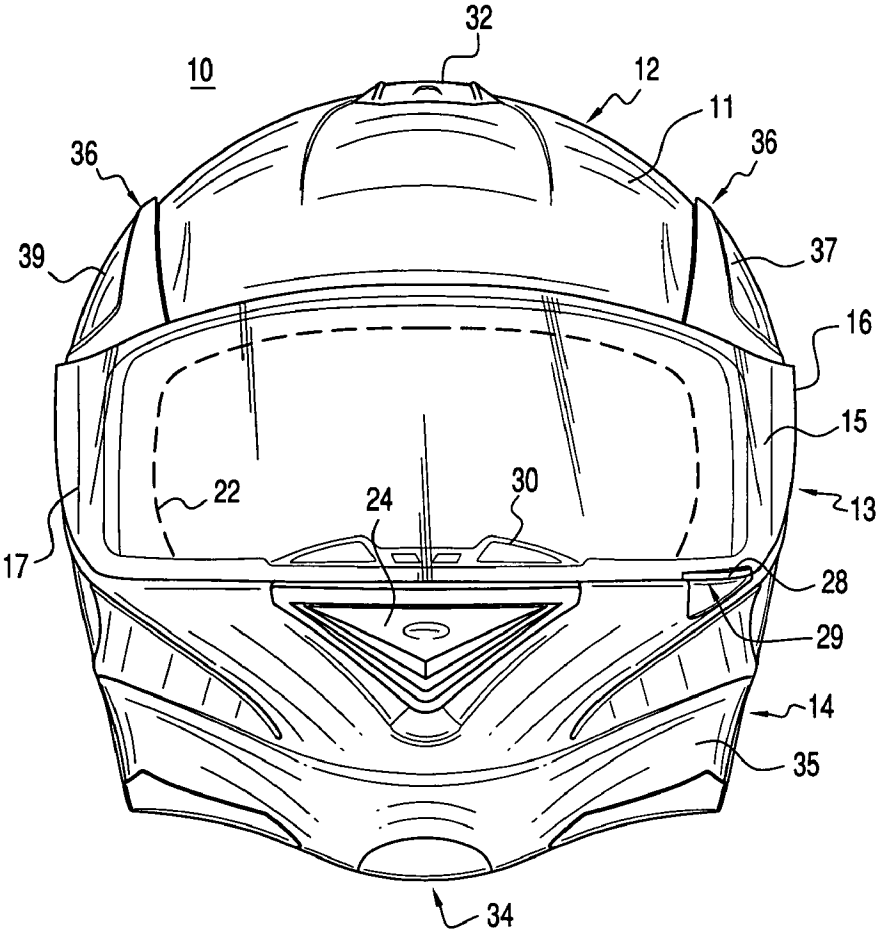
FIG. 2 is a front elevational view of the modular helmet shown in FIG. 1.

Referring to FIGS. 1 and 2, a perspective view of the exterior of an exemplary embodiment of a helmet in accordance with the present invention is shown. Specifically, a modular flip up helmet 10 comprises a cap body 12, a facial section 13 including a chin guard 14 and a visor 16, a left side chin guard hinge 18, a left side visor hinge 20, an inner liner 22, a front vent 24, a side vent 26, a visor finger catch 28, a front interior vent 30, a top vent 32, a chin guard actuator 34, and a left side chin guard side 36. The helmet 10 also includes a right side chin guard hinge 19, a right side visor hinge 21, and a right side chin guard side 37, not shown in FIGS. 1 and 2.

The helmet 10 provides protection through a combination of the cap body 12, which is often a hard shell, and the inner liner 22 (typically a crushable inner liner to absorb impact), and the facial section 13 through visor 16 that protects the eyes and the chin guard 14 that protects the face of a wearer.

Multiple vents are provided on the helmet for cooling and removal of moist exhaled air including the front vent 24 which may be slid open or closed, the top vent 32 which pops up and down, the left and right side vents 26 (only one of which is shown in FIG. 1), and the front interior vent 30 which functions to direct airflow into the helmet 10.

Figure 6:
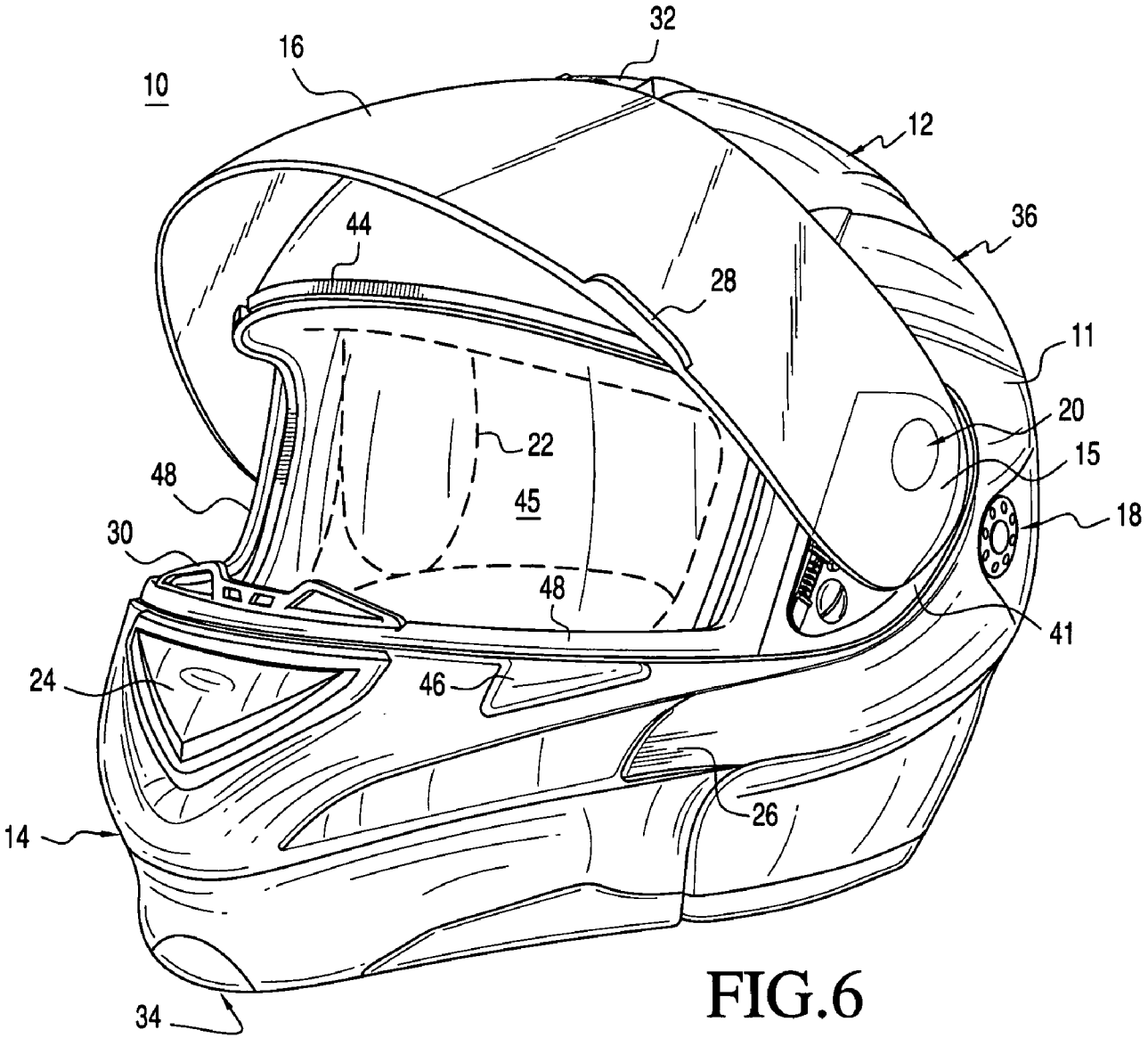
FIG. 6 is a perspective view of the front exterior of an exemplary embodiment of a helmet in accordance with the present invention with the visor raised relative to the cap body and chin guard.
Figure 10:
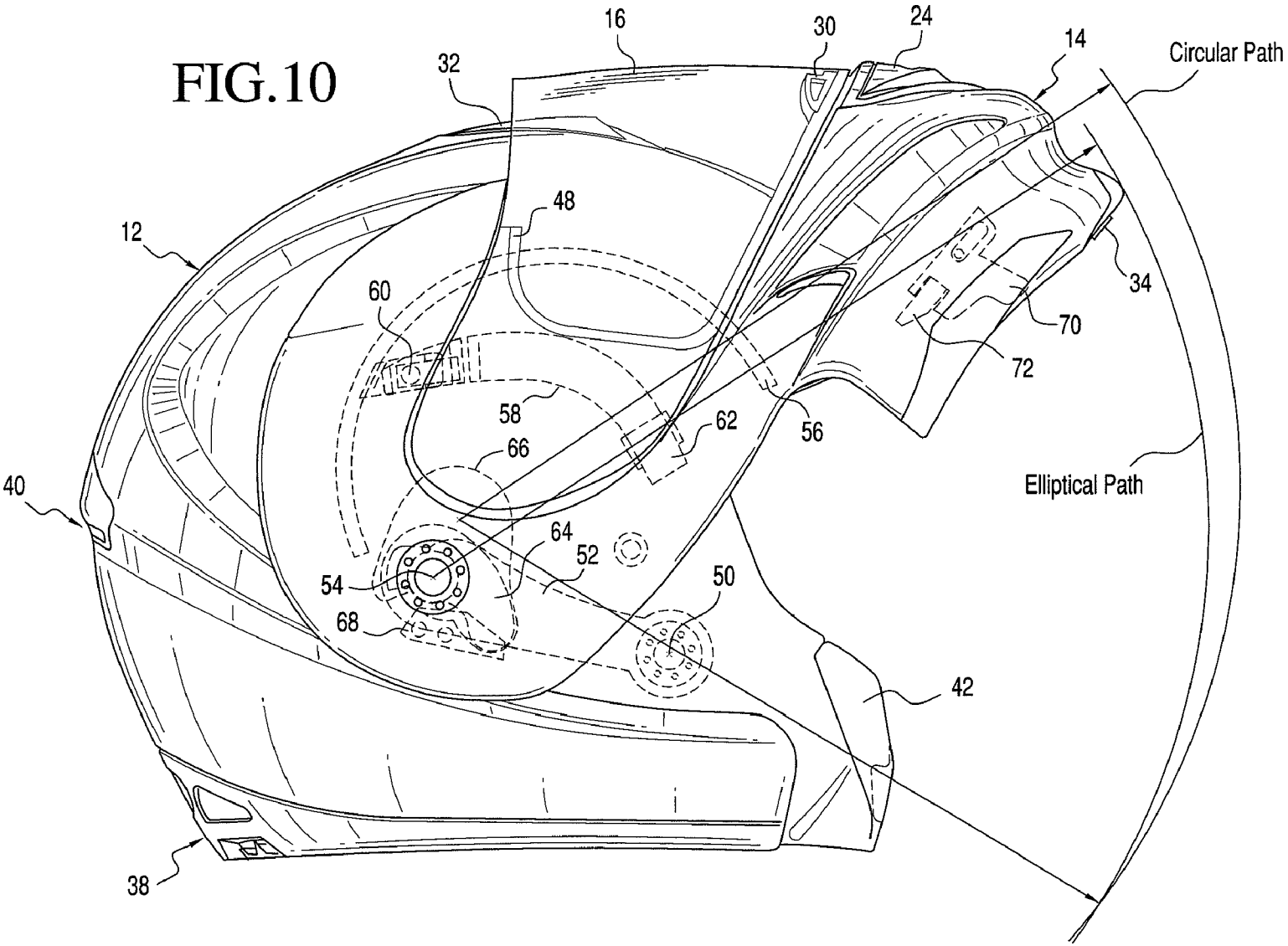
FIG. 10 is a left side profile view of the modular helmet shown in FIG. 1, with the visor and chin guard raised.

The chin guard 14 is attached to the cap body 12 by the left and right chin guard hinges 18 and 19, which permit the chin guard 14 to rotate up and down relative to the top of the helmet 10 (i.e. a wearer of the helmet 10 can raise the chin guard 14 up and away from in front of the wearer's face when desired as shown for example in FIG. 10). The visor 16 is attached to the chin guard 14 by a pair of visor hinges 20,21 that permit the visor 16 to be rotated relative to the chin guard 14 (and the helmet 10) as shown in FIG. 6.

The visor finger catch 28 is integral with the bottom of the visor 16 and extends outwardly therefrom and is used to raise and lower the visor 16. It should be appreciated that the visor finger catch 28 may be operated by gripping the outward extending surface 29 and applying an upward force, or merely using a finger to apply an force on the underside of surface 29. The finger catch 28 may be shaped and placed in other configurations. The visor lens may be an anti-fog lens or may be tinted or colored, and may also include tear-off film. The top vent 32 may be raised and lowered to provide airflow.

Figure 8:
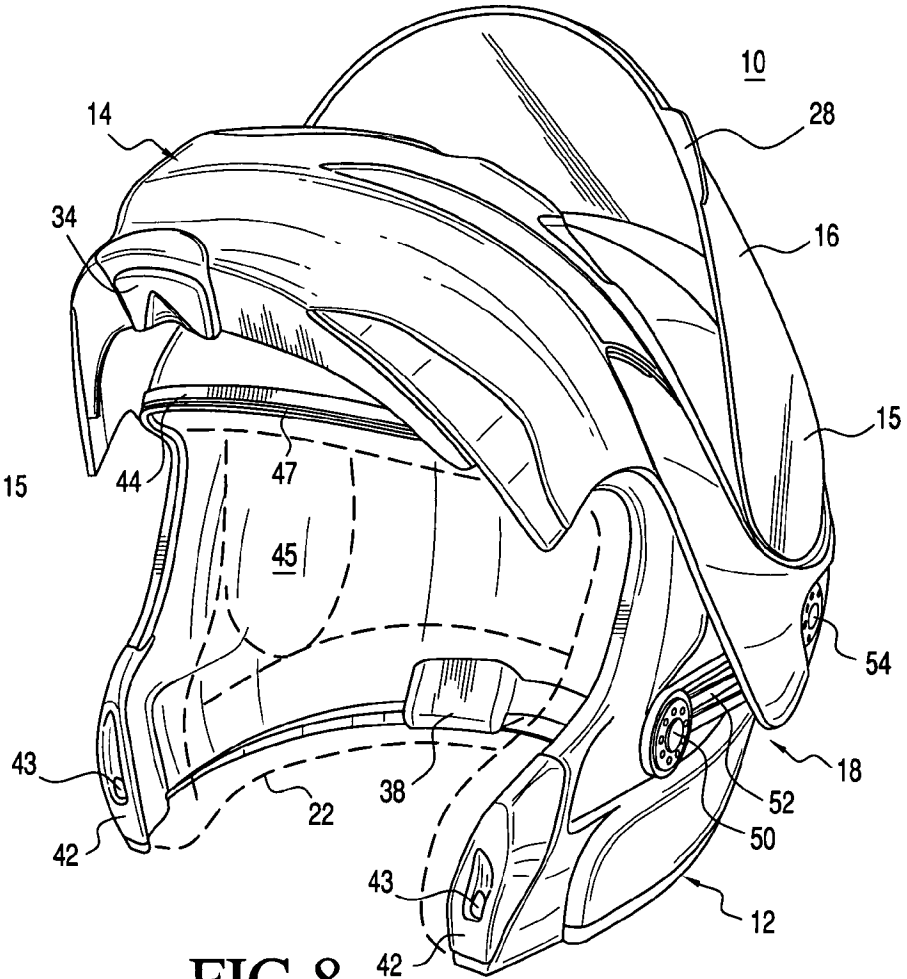
FIG. 8 is a perspective view of the front exterior of an exemplary embodiment of a helmet in accordance with the present invention that shows the visor and chin guard raised relative to the cap body.
Figure 7:
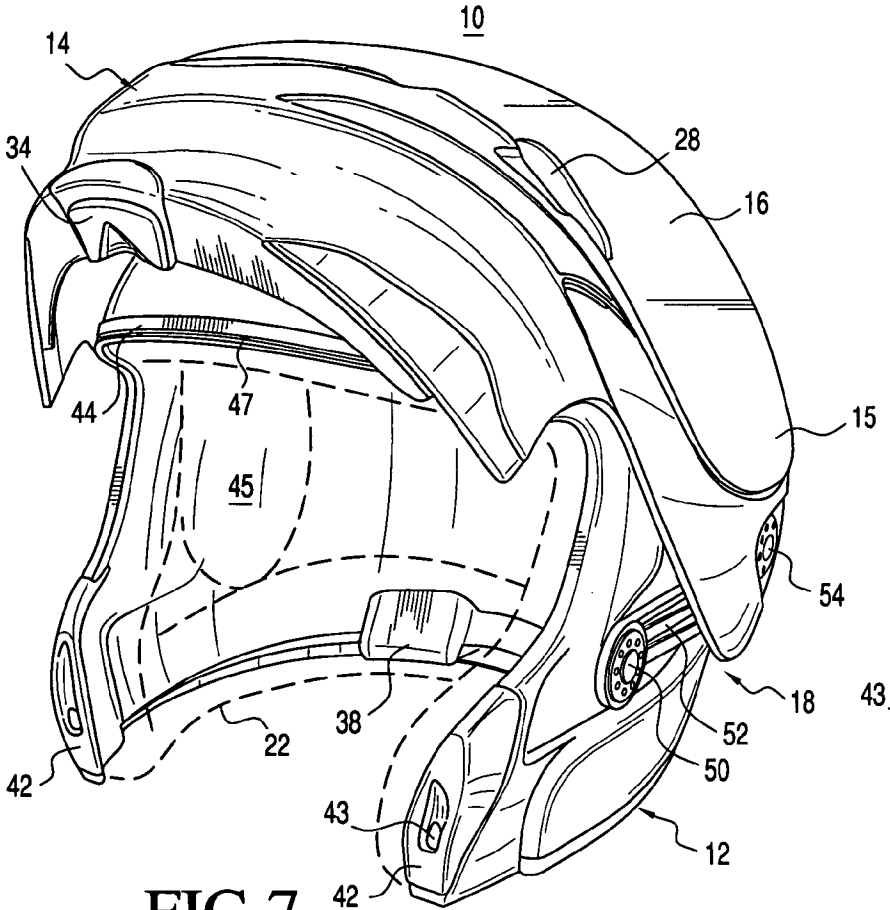
FIG. 7 is a perspective view of the front exterior of an exemplary embodiment of a helmet in accordance with the present invention with the chin guard raised relative to the cap body.
Figure 16:
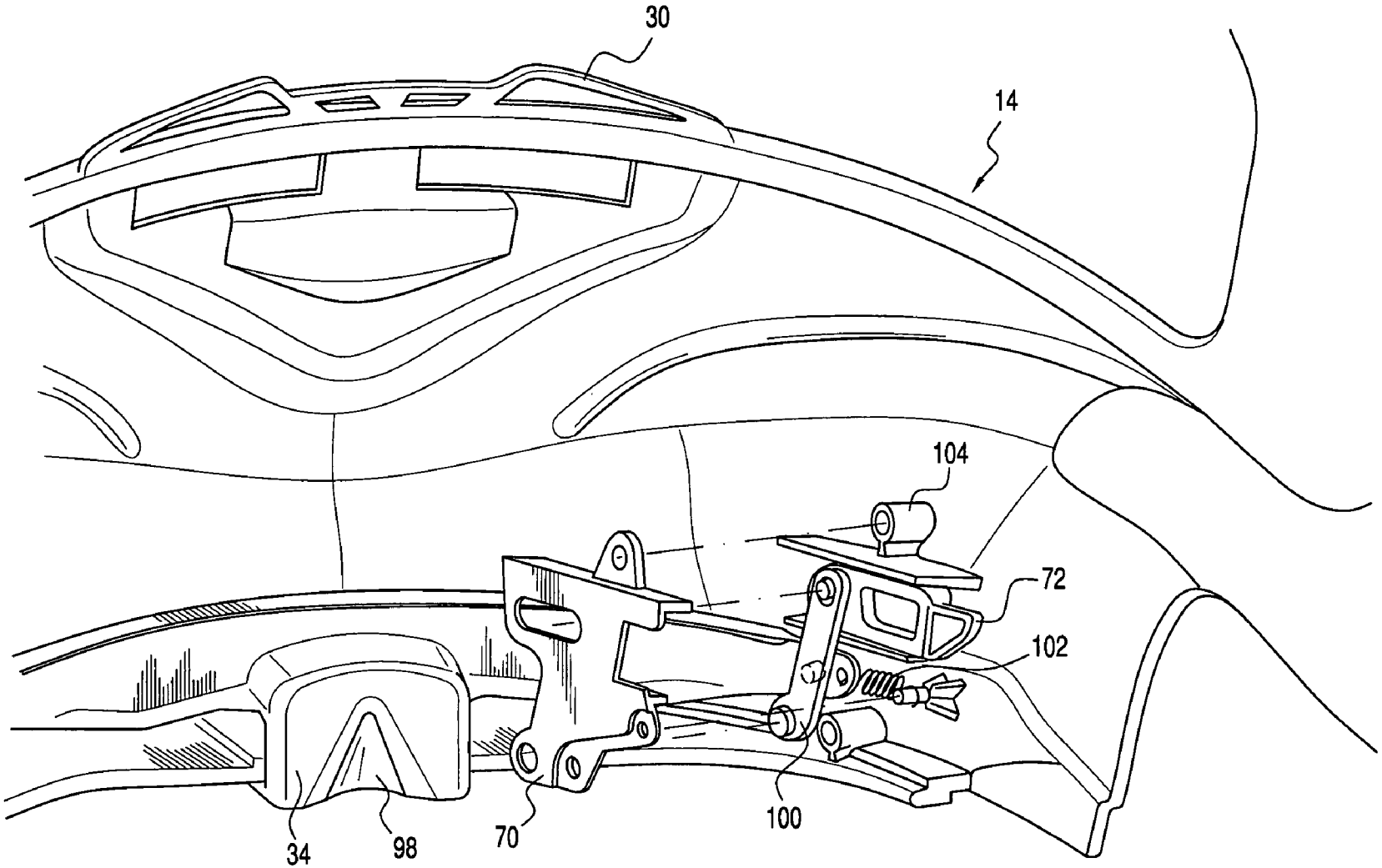
FIG. 16 is an exploded view of an exemplary embodiment of a chin guard lock mechanism in accordance with the present invention.

The chin guard 14 is kept in a lowered position by a locking mechanism (not shown in FIG. 1) that is described in greater detail below in conjunction with FIGS. 16, 17, and 18. The chin guard actuator 34 located on the front of the helmet serves to release the locking mechanism when actuated. Once the chin guard actuator 34 has been actuated, the chin guard 14 may be raised. Both the chin guard 14 and the visor 16 can be raised and lowered independently of each other. The left and right chin guard sides 36,37 are disposed over the chin guard hinges on each side of the helmet 10. The chin guard 14 includes a front chin protection section and a rearward "C" shaped sections 37,39 that each provide a recessed chamber 41 that supports the left and right visor hinges 20,21 and which serves to receive left and right rearward portions 15,17 of the visor in a substantially flush engagement with the outer surface of the cap body 12. As best shown in FIGS. 7, 8 and 16, the chin guard actuator 34 is a thumb catch that allows the chin guard lock to be released using a single button release disposed on the inside of the chin guard 14. It should be appreciated that the chin guard actuator 34 could be constructed in various forms without departing from the scope of the invention.

Figure 3:
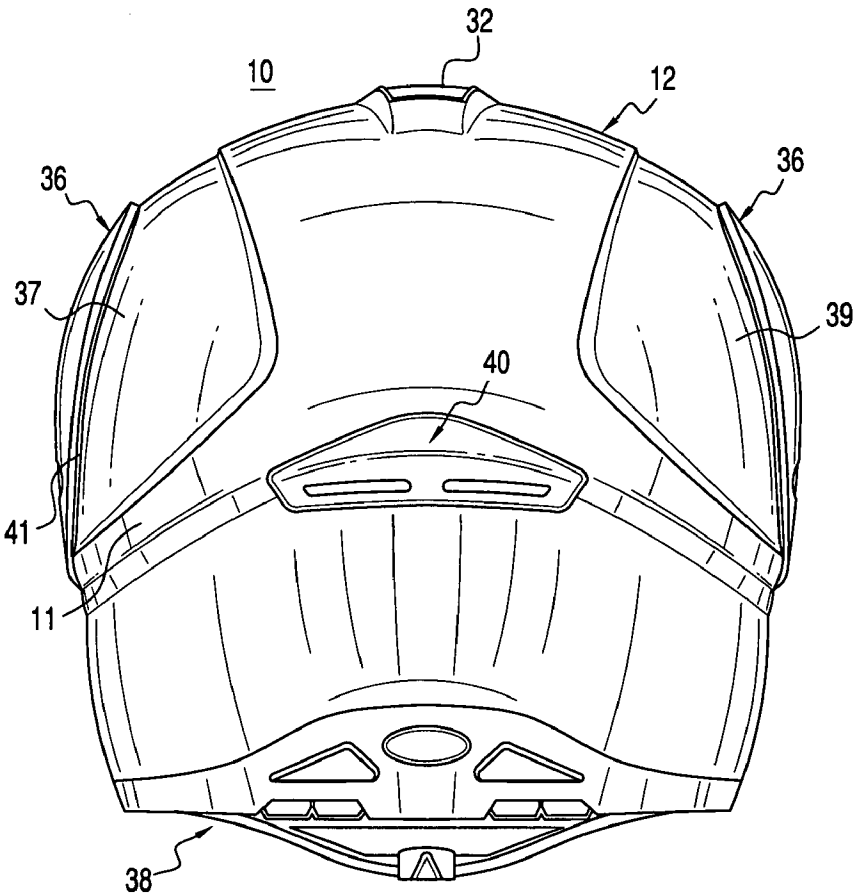
FIG. 3 is a rear elevational view of the modular helmet shown in FIG. 1.

FIG. 3 is a rear view of the exterior of the modular helmet 10. As shown in FIG. 3, the left and right chin guard sides 36 and 37 extend from the front chin guard section 35 around to the sides of the cap body. The left and right chin guard sides 36,37 are disposed over the chin guard hinges 18,20 on each side of the cap body 12 when the chin guard 14 is in its closed position as shown in FIGS. 1 and 2.

Figure 4:
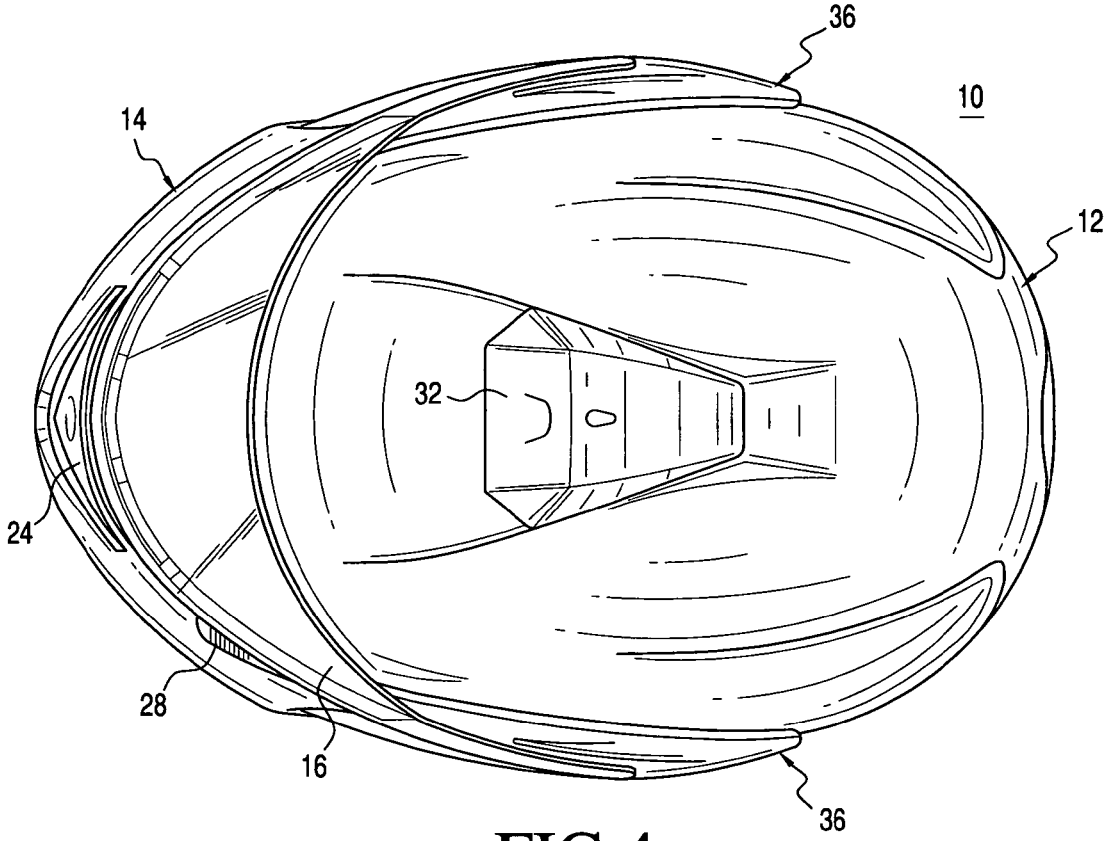
FIG. 4 is a top plan view of the modular helmet shown in FIG. 1.

FIG. 4 is a top plan view of the modular helmet shown in FIG. 1. In particular, FIG. 4 shows the top vent 32 in greater detail. The top vent 32 includes a front portion that is an actuator that, when pressed, raises the rear portion of the top vent which is an air scoop. Air coming in the front vent, side vents, or top vent 32 is exhausted from the helmet 10 at either of the upper rear vent 40 or the lower rear vent 38.

Figure 5:
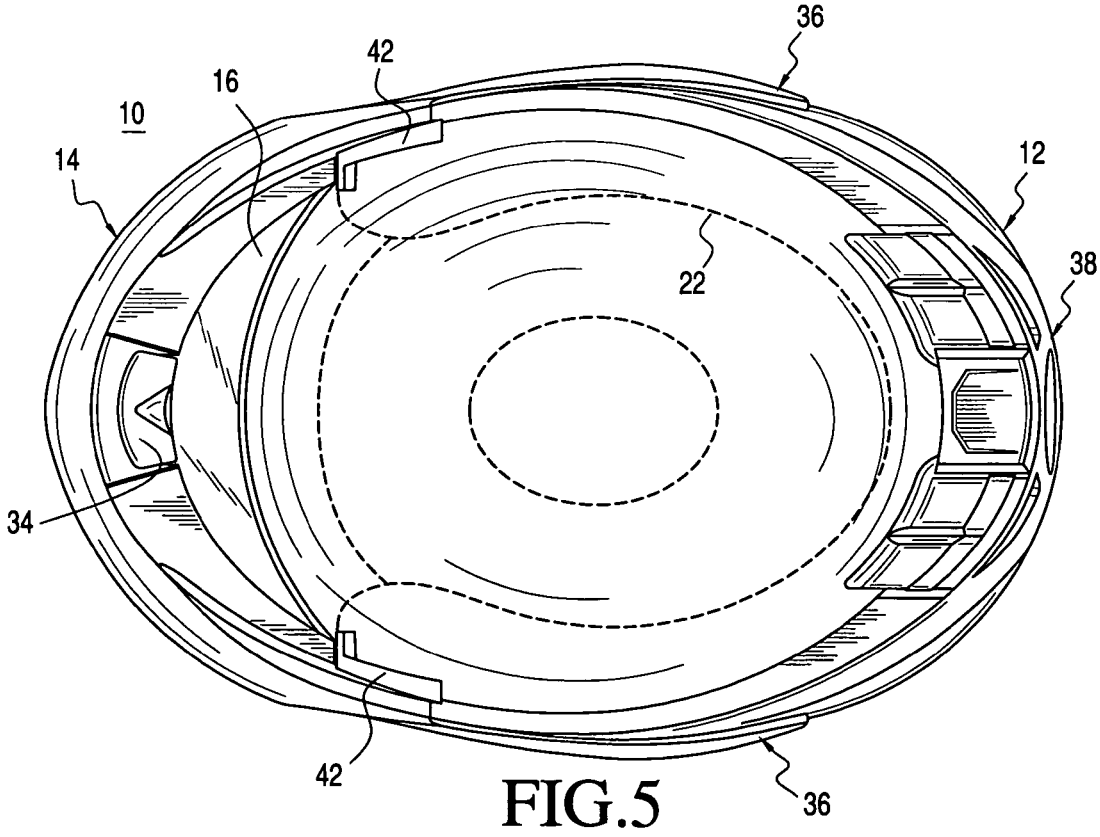
FIG. 5 is a bottom plan view of the modular helmet shown in FIG. 1.

FIG. 5 is a bottom plan view of the modular helmet shown in FIG. 1. In FIG. 5 an exemplary configuration of the inner liner 22 is shown, wherein the inner liner 22 lines the inside of the cap body 12 forming an impact absorbing layer between the head of the wearer and the hard outer shell of the cap body 12.

The chin guard actuator 34 is disposed beneath the chin guard front section 13. The chin guard lock (or latch) plates 42 are fitted at opposite sides of cap body 12 as best shown in FIGS. 7 and 8 and include a reinforced opening that receives a chin guard lock hook. The chin guard lock plates 42 may be made of magnesium, or other metal, to advantageously enhance durability and to provide a secure lock for the chin guard. However, it should be appreciated that other materials that provide appropriate physical properties may be used.

FIG. 6 is a left front perspective view of the helmet 10 and shows the visor 16 raised relative to the cap body 12 and chin guard 14 to an open position. A cap body visor seal 44 is provided above the opening 45 and in a groove 47. The seal 44 extends outward slightly from the surface of the cap body 12 to sealingly engage inside surface of the visor 16 and prevent wind or water from entering the interior of helmet 10 through the opening 45.

When the visor 16 is fully lowered and the chin guard 14 is fully lowered, the cap body visor seal 44 and a chin guard visor seal 48 form a seal between the visor and the cap body 12 and chin guard 14 to prevent air and or moisture from entering the top or sides of the visor 16 at the interface between the visor 16 and the cap body 12 and chin guard 14.

A visor finger catch recess 46 is provided just below the visor finger catch 28 and allows a finger to more effectively be positioned below the exterior 28 of the visor finger catch.

FIG. 7 is a perspective view of the front exterior of an exemplary embodiment of a helmet in accordance with the present invention with the chin guard raised relative to the cap body. As shown in FIG. 7, each chin guard hinge 18 comprises a fixed axis joint 50 coupled to a floating axis joint 54 by a swing arm 52. The chin guard hinges 18 and 19 permit the chin guard 14 to rotate up and back toward the top and back of the helmet 10. The combination of the fixed axis joint 50, swing arm 52 and floating axis joint 54 provide a substantially elliptical rotational travel path for the chin guard. The elliptical travel path, or trajectory, of the chin guard serves to reduce the front surface area of the helmet when the chin guard is in a raised position, as compared to a chin guard having a non-elliptical rotational trajectory. The reduced front surface area permits easier wear of the helmet during activities with the chin guard raised. The chin guard hinges 18 and 19 are disposed in contoured recesses in each side of the cap body and allow the left and right chin guard sides 36 and 37 to move away from and over the cap body surface during rotation. This arrangement advantageously avoids contact between the inner surface of the chin guard sides 36 and 37 and the outer surface of the cap body 12. This not only protects the outer surface of the cap body from scratches, but it enables free unobstructed movement of the chin guard between its open and closed positions.

FIG. 8 is a perspective view of the front exterior of an exemplary embodiment of a helmet in accordance with the present invention that shows the visor and chin guard raised relative to the cap body. As shown in FIG. 8, it can be seen that the chin guard 14 and the visor 16 can each be rotated independently relative to the cap body 12 so that the helmet 10 may be worn with the chin guard 14, or visor 16, raised or lowered.

Figure 9:
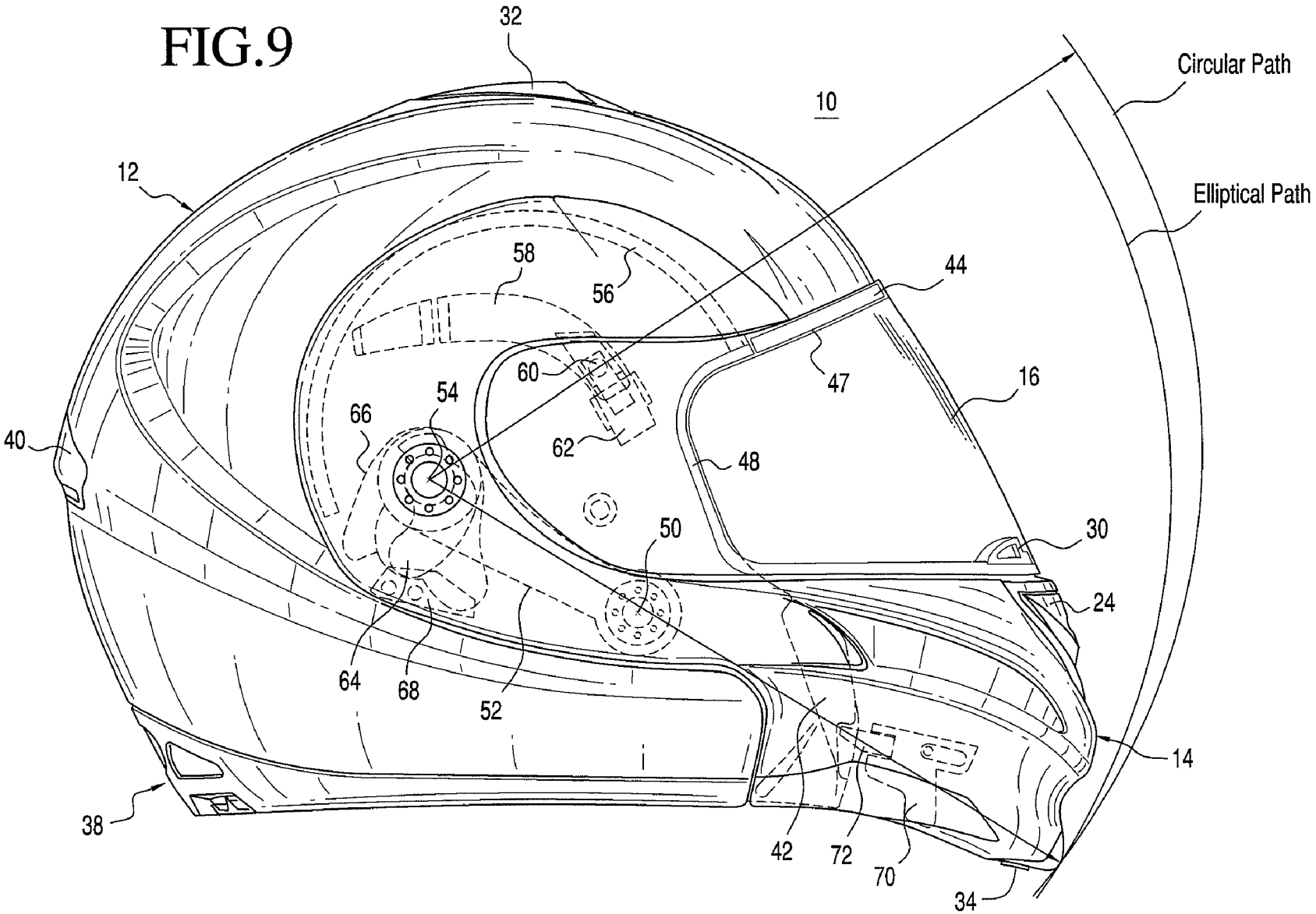
FIG. 9 is a left side profile view of the modular helmet shown in FIG. 1, with the visor and chin guard lowered.

As shown in FIG. 9 the helmet 10 further comprises a side seal 56, a track 58, a lock hook 60, a hook cap 62, a swivel cam 64, a contoured cap body recess 66, a cam plate 68, a chin guard lock cap 70, and a chin guard lock hook 72. The chin guard hinge 18 attaches the chin guard 14 to the cap body 12 and permits the chin guard to rotate relative to the cap body 12. When the chin guard 14 is lowered, or in its closed position, the chin guard lock hook 72 engages the chin guard lock plate 42 to secure the chin guard in the lowered position. When the chin guard actuator 34 is actuated, the chin guard lock hook 72 is released and withdraws from the lock plate 70 to enable the chin guard 14 to be rotated upwardly relative to the cap body 12.

FIG. 10 is a left side profile view of the modular helmet shown in FIG. 1, with the visor and chin guard raised. The chin guard 14 has been raised by rotating the chin guard 14 on the chin guard hinges 18 (a second chin guard hinge 18 is disposed on the other side of the helmet not visible in this view). As shown in FIG. 10, the helmet 10 further comprises a side seal 56, a track 58, a lock hook 60, a hook cap 62, a swivel cam 64, a contoured cap body recess 66, a cam plate 68, a chin guard lock cap 70, and a chin guard lock hook 72. When the chin guard rotates on the chin guard hinges 18 and 19, the lock hook 60 on the chin guard 14 follows along a track 58 in the cap body 12 as the chin guard 14 is raised and lowered. The track 58 and lock hook 60 work cooperatively to provide directional guidance and stability to the chin guard as is raised and lowered. As the chin guard 14 is nearing the fully lowered position, the lock hook 60 engages the lock hook cap 62. The lock hook cap causes the chin guard side 36 to be pressed against the side of the cap body 12 to create a smooth surface at the sides of the chin guard to decrease wind resistance and noise.

Figure 11:
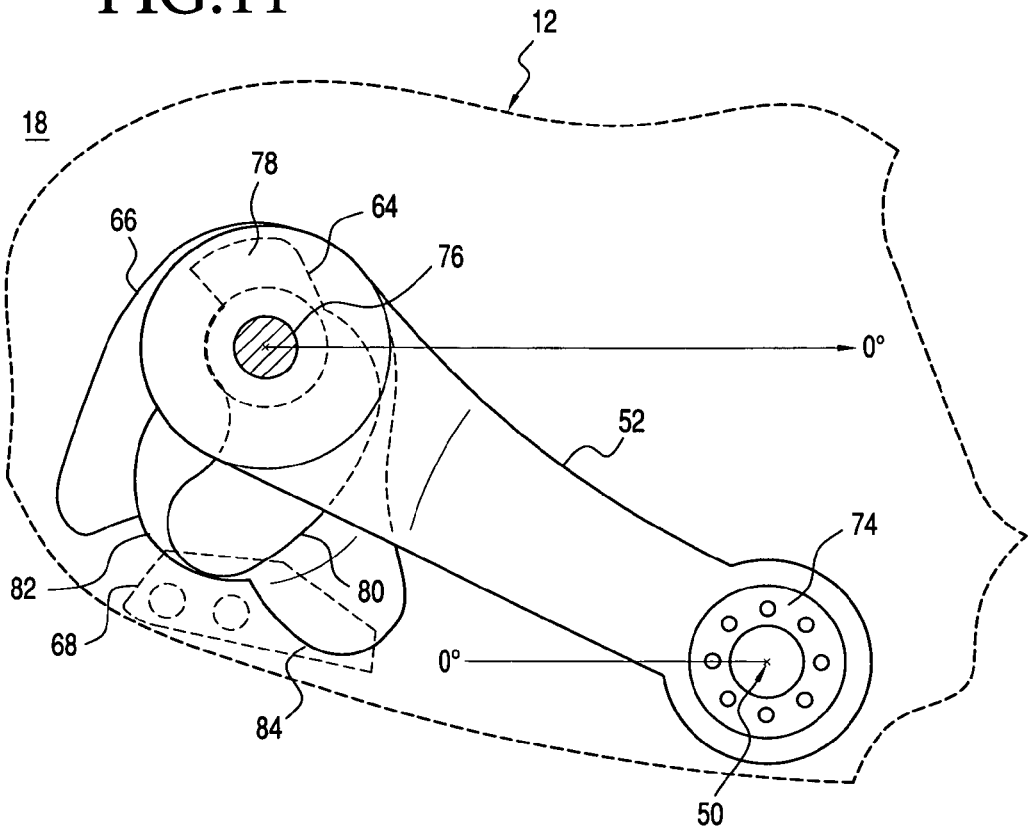
FIG. 11 is a fragmentary detail view of an exemplary chin guard hinge of the present invention in a lowered position.

FIG. 11 is a fragmentary detail view of an exemplary chin guard hinge of the present invention in a lowered position. In particular, the chin guard hinge 18 comprises a recess 66 on the cap body 12, a swing arm 52, a swivel cam 64, a floating axis joint 54, and a fixed axis joint 50. The swivel cam 64 comprises an upper lobe 78 and a lower lobe 80. The recess 66 comprises a first indention 82, and a second indention 84.

Generally, the chin guard hinge 18 is a compound hinge and permits the chin guard to be raised through a combination of movements that take place within the compound hinge. The chin guard rotates about the floating axis joint 54. As the chin guard rotates about the floating axis joint 54, the swivel cam 64 rotates in the cap body recess 66 and allows the swing arm 52 to rotate downward about the fixed axis joint 50 relative to the cap body. The downward rotation of the swing arm 52 in conjunction with the movement of the swivel cam 64 cause the floating axis joint 54 to substantially trace a relatively short elliptical arc path in a generally downward direction relative to the top of the cap body 12. The recess 66 includes indentions that engage the swivel cam 64 as it rotates and provide rotational guidance and limits for the chin guard 14 rotation. The indentions also act as stops for the cam and hold the cam in place once the chin guard is raised. In FIG. 11, the chin guard 14 is in a lowered position with the lower lobe 80 resting in the first indention 82.

Figure 12:
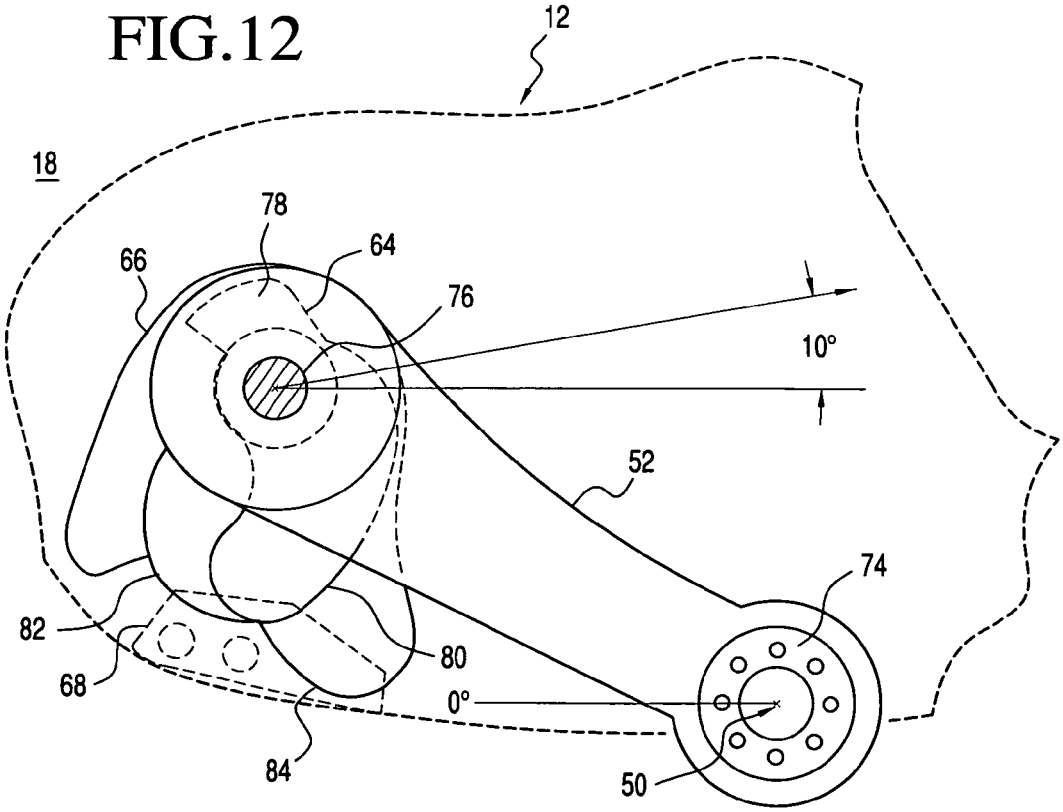
FIG. 12 is a fragmentary detail view of an exemplary chin guard hinge of the present invention in a partially raised position.

FIG. 12 is a fragmentary detail view of an exemplary chin guard hinge of the present invention in a partially raised position. In particular, FIG. 12 shows the chin guard hinge 18 when the chin guard is raised about 10°. At this position, the lower lobe 80 has now moved to a location between the first indention 82 and the second indention 84. As the chin guard has rotated up about, the swivel cam 64 has rotated to a position between the first indention 82 and the second indention 84. Also, the recess 60, in addition to the first indention 82, and the second indention 84, may further comprise a surface that has raised and lowered portions (not shown), these raised and lowered portions may cause the swivel cam 64 to move outwardly toward the outside of the cap body as the chin guard is rotated up, and cause the swing arm 52 to flex. When the chin guard has been rotated up all the way (i.e. fully raised) the swivel cam 64 may rest in a lowered portion of the recess 60, thus keeping the chin guard held in the raised position under force of the swing arm 52 pressing against the cap body and holding the swivel cam 64 in the lowered portion of the recess 60. In the position shown in FIG. 12, the swing arm 52 has not rotated about the fixed axis joint 50.

Figure 13:
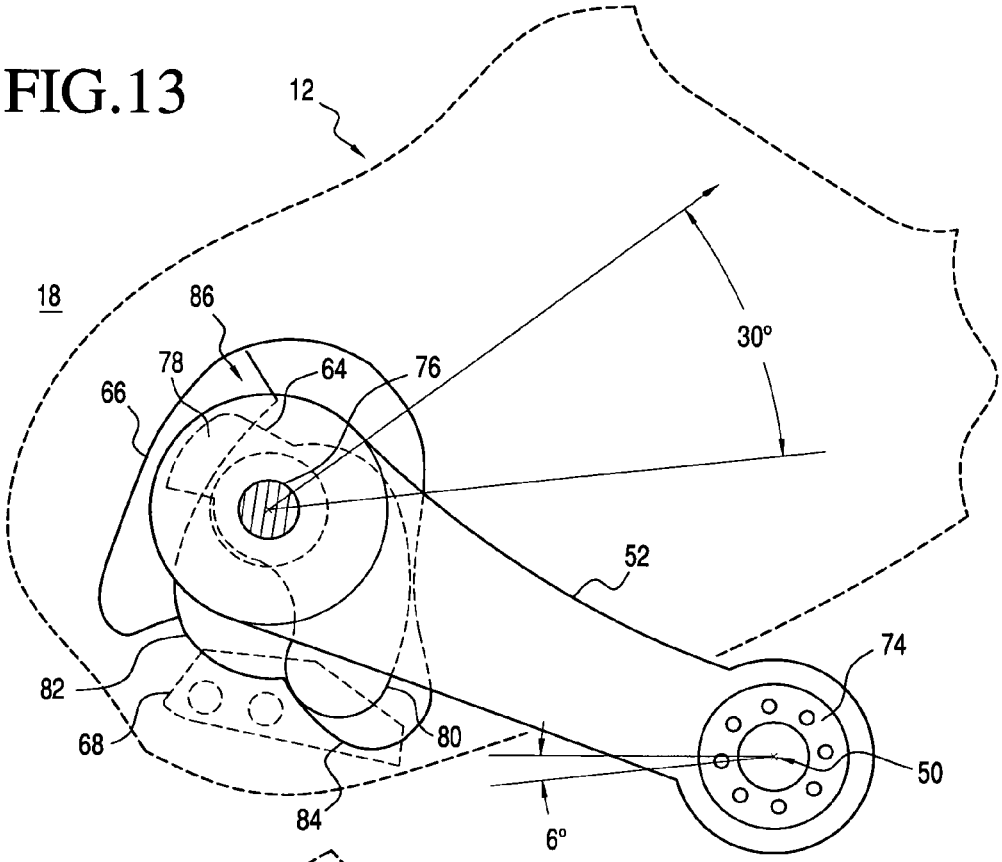
FIG. 13 is a fragmentary detail view of an exemplary chin guard hinge of the present invention in a partially raised position.

FIG. 13 is a fragmentary detail view of an exemplary chin guard hinge of the present invention in a partially raised position. In particular, FIG. 13 shows the chin guard hinge 18 when the chin guard is raised about 30°. At this position, the lower lobe 80 of the swivel cam 64 has now moved to a location partially in the second indention 84. Also, at this position, the swing arm 52 has about 6° of rotation in a downward about the fixed axis joint 50 causing the floating axis joint 54 to rotate a corresponding amount.

Figure 14:
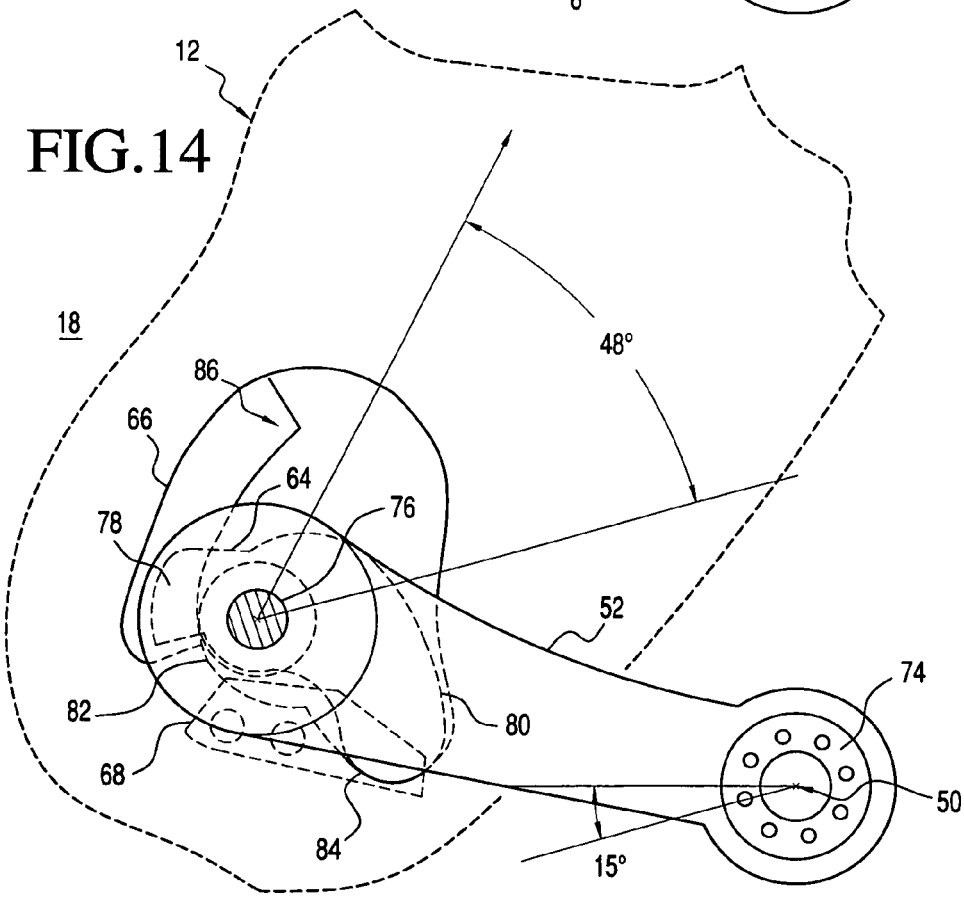
FIG. 14 is a fragmentary detail view of an exemplary chin guard hinge of the present invention in a fully raised position.

FIG. 14 is a fragmentary detail view of an exemplary chin guard hinge of the present invention in a fully raised position. In particular, FIG. 14 shows the chin guard hinge 18 when the chin guard is raised about 48° (representing, in this example, a fully raised position). It should be appreciated that the angles shown in these figures are for illustration only and that the chin guard is continuously adjustable and various positions ranging from fully lowered to fully raised may be reached. Further the fully raised angle shown is for illustration purposes only and other fully raised angles may be used depending upon contemplated uses of the invention.

At the position shown in FIG. 14, the lower lobe 80 of the swivel cam 64 has now moved to a location fully in the second indention 84. Also, at this position, the swing arm 52 has about 15° of rotation about the fixed axis joint 50 allowing the floating axis joint 54 to be lowered toward the base of the helmet. The upper lobe 78 of the swivel cam 64 has come to rest adjacent to the first indention 82, which acts as a stop for the upper lobe 78. Further, if the recess is provided with concave and convex portions, the concave portion may be in the surface of the second indention 84 to hold the lower lobe 80 of the swivel cam 64 once it has fully aligned with the second indention 84. Thus, with the upper lobe 78 of the swivel cam 64 resting adjacent to the first indention 82 and the lower lobe 80 of the swivel cam 64 resting in the second indention 84 (and possibly resting in a concave portion provided in the second indention 84), the chin guard is fully raised and in a secure position that will not allow it to raise further nor fall down under the force of gravity. It should be appreciated that different quantities, shapes, and configurations of cams and cam lobes could be used depending upon the contemplated use of the invention.

Figure 15:
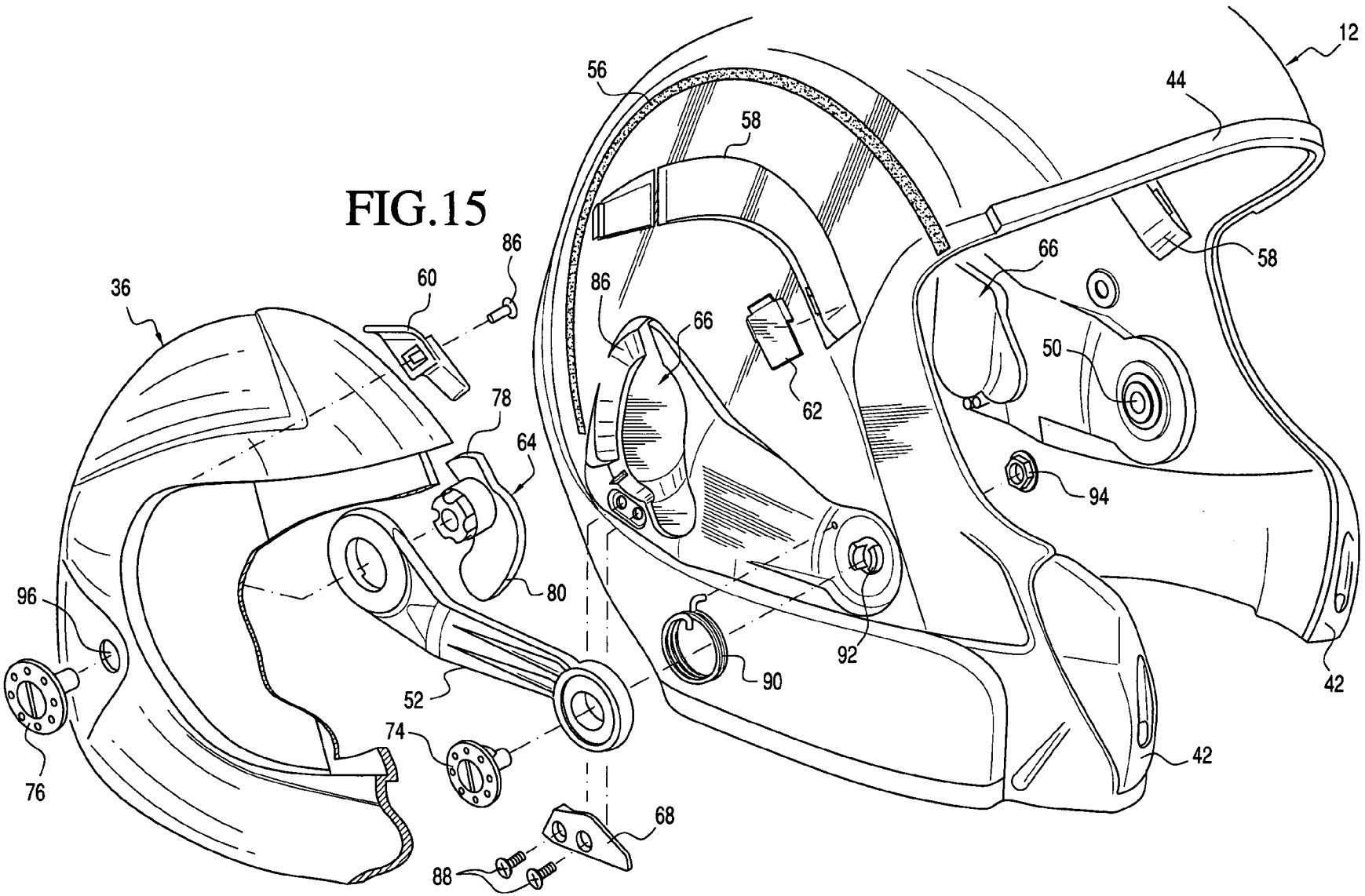
FIG. 15 is an exploded view of the modular helmet shown in FIG. 1.

FIG. 15 is an exploded view of the modular helmet shown in FIG. 1. Specifically, A modular flip up helmet 10 comprises a cap body 12, a chin guard 14, a visor 16, a chin guard hinge 18, an inner liner 22, a visor finger catch 28, a chin guard actuator 34, a lower rear vent 38, chin guard lock plates 42, a cap body visor seal 44, and a chin guard visor seal 48. The chin guard hinge 18 comprises a fixed axis joint 50 coupled to a floating axis joint 54 by a swing arm 52. The helmet 10 further comprises a side seal 56, a track 58, a lock hook 60, a hook cap 62, a swivel cam 64, a contoured cap body recess 66, a cam plate 68, a chin guard lock cap 70, and a chin guard lock hook 72.

When assembled, the rear bolt 76 passes through the floating axis hinge mounting hole 96 on the side of the chin guard, through the swing arm 52 and into the swivel cam 64. The floating axis joint 54 is attached to the swivel cam 64, by interlocking, with a fastener (not shown), or by any other suitable means. The swivel cam 64 may have an outer diameter that fits within the inner diameter of the end of the swing arm 52. Further, the swivel cam 64 may have recesses to engage the swing arm 52 or the rear bolt 76.

The swivel cam 64 rests in the recess 66 and is secured in place by the cam plate 68 that is held in place by the cam retainer mounting screws 88 placed into the cam retainer mounting holes on the cap body 12.

The front bolt 74 passes through the swing arm 52, engages the fixed axis hinge spring 90, and passes into the fixed axis hinge mounting hole 92 on the cap body 12 and is secured by the fixed axis hinge fastener 94. The front bolt 74 forms a front rotational portion of the compound chin guard hinge and is under tension of fixed axis hinge spring 90 that engages the front bolt 74 and a spring hole 108 in the cap body portion 80.

The chin guard 14 also has a lock hook 60 that is fixed to the chin guard via the mounting fastener 96. When the helmet is assembled, the lock hook 60 travels in the track 58 on the cap body 12. The chin guard rotation may be limited by stops. The seal 56 provides a seal between the chin guard and the cap body. The seal may extend partially or fully around the interface between the chin guard and the cap body.

It should be appreciated that FIG. 15 illustrates a first side of the chin guard hinge and the other side of the helmet has a complementary chin guard hinge having a similar set of components arranged to function as the opposite side chin guard hinge.

FIG. 16 is an exploded view of an exemplary embodiment of a chin guard lock mechanism in accordance with the present invention. In particular, the chin guard 14 includes a chin guard actuator 34, a chin guard lock cap 70, a chin guard lock lever 100, mounting off features 104, chin guard lock spring 102, chin guard lock hook 72.

When assembled, the chin guard actuator 34 is disposed on the inside of the chin guard. The chin guard actuator 34 is positioned so that a rider can actuate it by inserting his thumb (or other finger) between his chin and the chin guard and pressing away from his face. This construction permits easy release of the chin guard while helping to prevent accidental release. It should be appreciated that the chin guard release actuator could be disposed in other places on the chin guard or on the helmet (if the chin guard release mechanism was disposed in the helmet), depending upon contemplated uses of the invention.

The chin guard release mechanism includes a chin guard lock cap 70, a chin guard lock lever 100, mounting off features 104, chin guard lock hook 72, and a chin guard lock spring 102.

The chin guard actuator 34 extends from the center of the chin guard to each side of the chin guard 14 coupling the chin guard actuator 34 to the chin guard lock lever 100. The chin guard actuator 34 transfers motion to the chin guard lock lever 100 causing the chin guard lock lever 100 to rotate in a direction such that the chin guard lock hook 72 is retracted from the cap body detent (not shown). Further, the chin guard actuator 34 may flex in response to force exerted thereon and provide resistance to the release of the lock mechanism.

The chin guard lock hook 72 moves back and forth in the mounting off features 104. The chin guard lock cap 70 is placed over the chin guard lock lever 100 and chin guard lock hook 72, and attached to the chin guard 14 to keep the chin guard detent mechanism in place. The chin guard lock lever 100 is rotationally coupled to the chin guard lock hook 72 and to an axle protruding from the side of the chin guard.

The chin guard lock spring 102 is coupled to the chin guard 14 and to the chin guard actuator 34. The chin guard lock spring 102 is disposed such that it provides tension to chin guard actuator 34 (and by transfer to the chin guard lock lever 100) to keep the chin guard lock hook 72 extended in a direction toward the cap body. The purpose of this arrangement is to keep the chin guard lock hook engaged with the cap body detents when the chin guard is lowered, and to not allow the chin guard to be raised until the chin guard actuator 34 is pressed.

Figure 17:
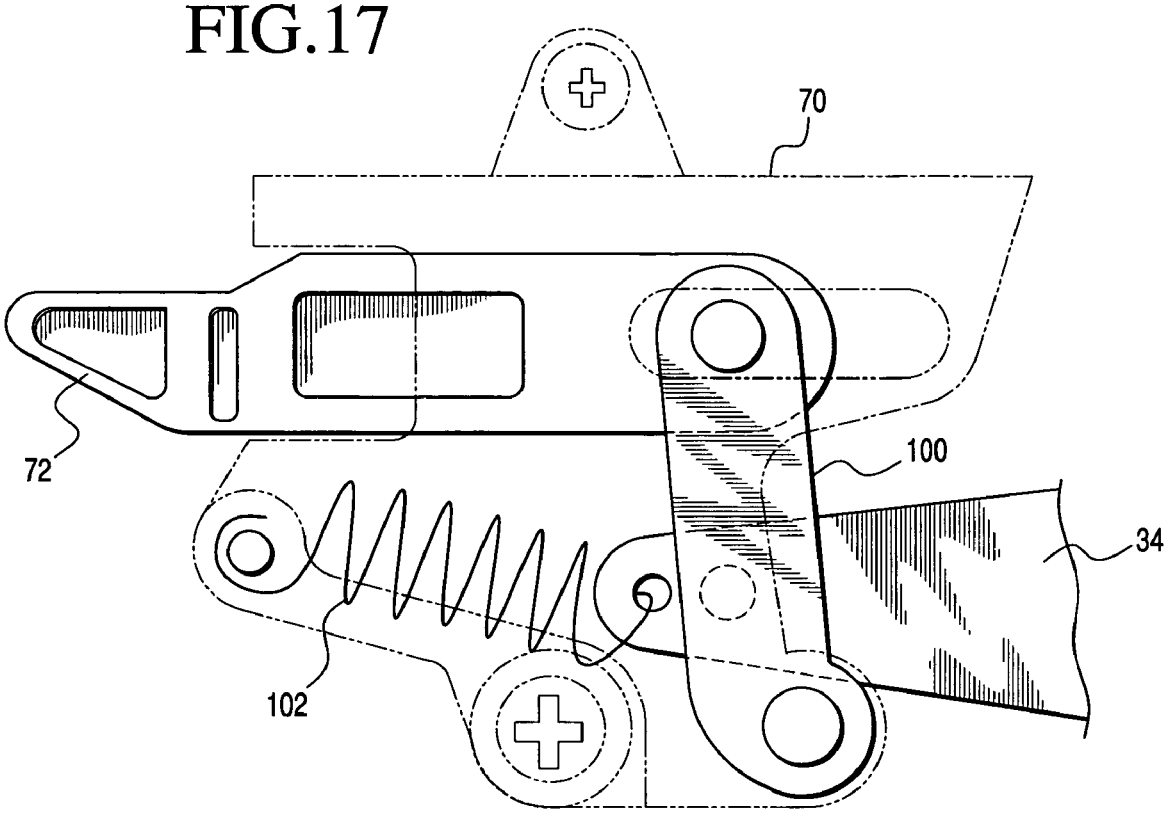
FIG. 17 is a side elevational view of an exemplary embodiment of a chin guard lock mechanism in accordance with the present invention, with the lock hook extended.

FIG. 17 is a side elevational view of an exemplary embodiment of a chin guard lock mechanism in accordance with the present invention, with the lock hook extended. In particular, the chin guard lock hook 72 is shown in an extended position, the chin guard lock cap 70 is shown as invisible for illustration purposes, and the chin guard lock lever 100 is shown coupled to the chin guard lock hook 72. The chin guard lock spring 102 is not extended.

Figure 18:
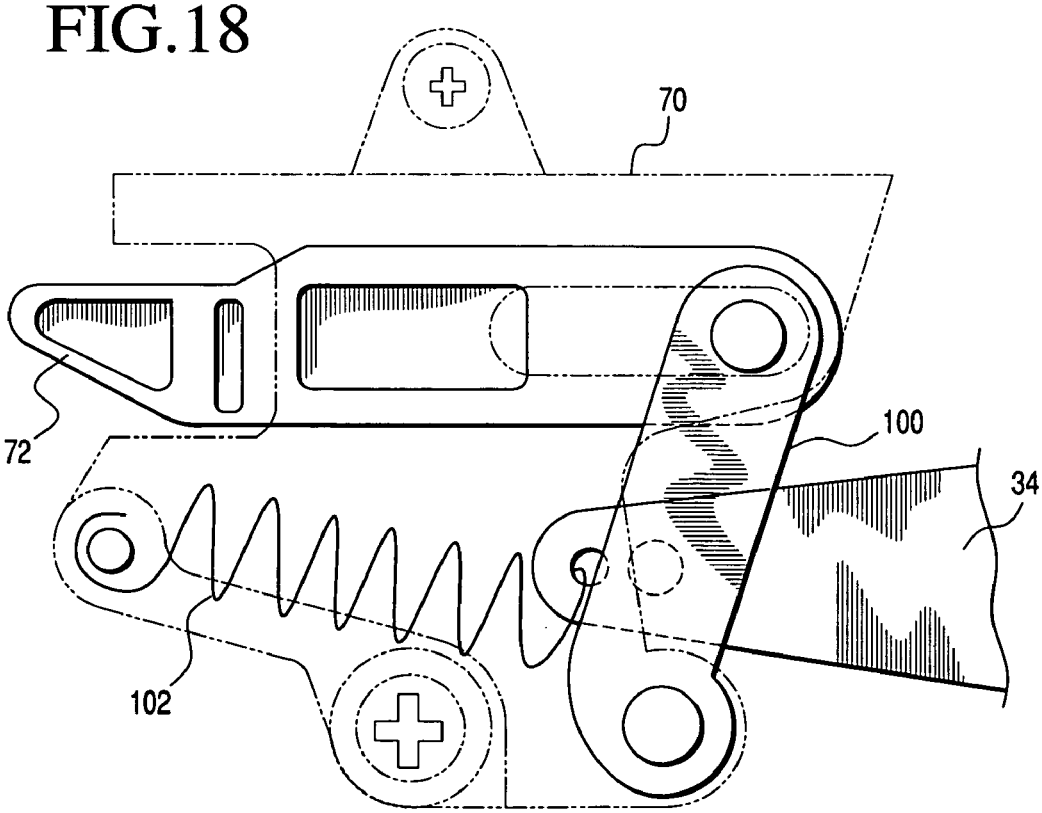
FIG. 18 is a side elevational view of an exemplary embodiment of a chin guard lock mechanism in accordance with the present invention, with the lock hook retracted.

FIG. 18 is a side elevational view of an exemplary embodiment of a chin guard lock mechanism in accordance with the present invention, with the lock hook retracted. In particular, the chin guard lock hook 72 is shown in a retracted position, the chin guard lock cap 70 is shown as invisible for illustration purposes, and the chin guard lock lever 100 is shown coupled to the chin guard lock hook 72 and the chin guard lock hook 72. The chin guard lock spring 102 is now extended and the chin guard lock lever 100 is rotated in a direction such that the chin guard lock hook 72 is retracted.

Figure 19:
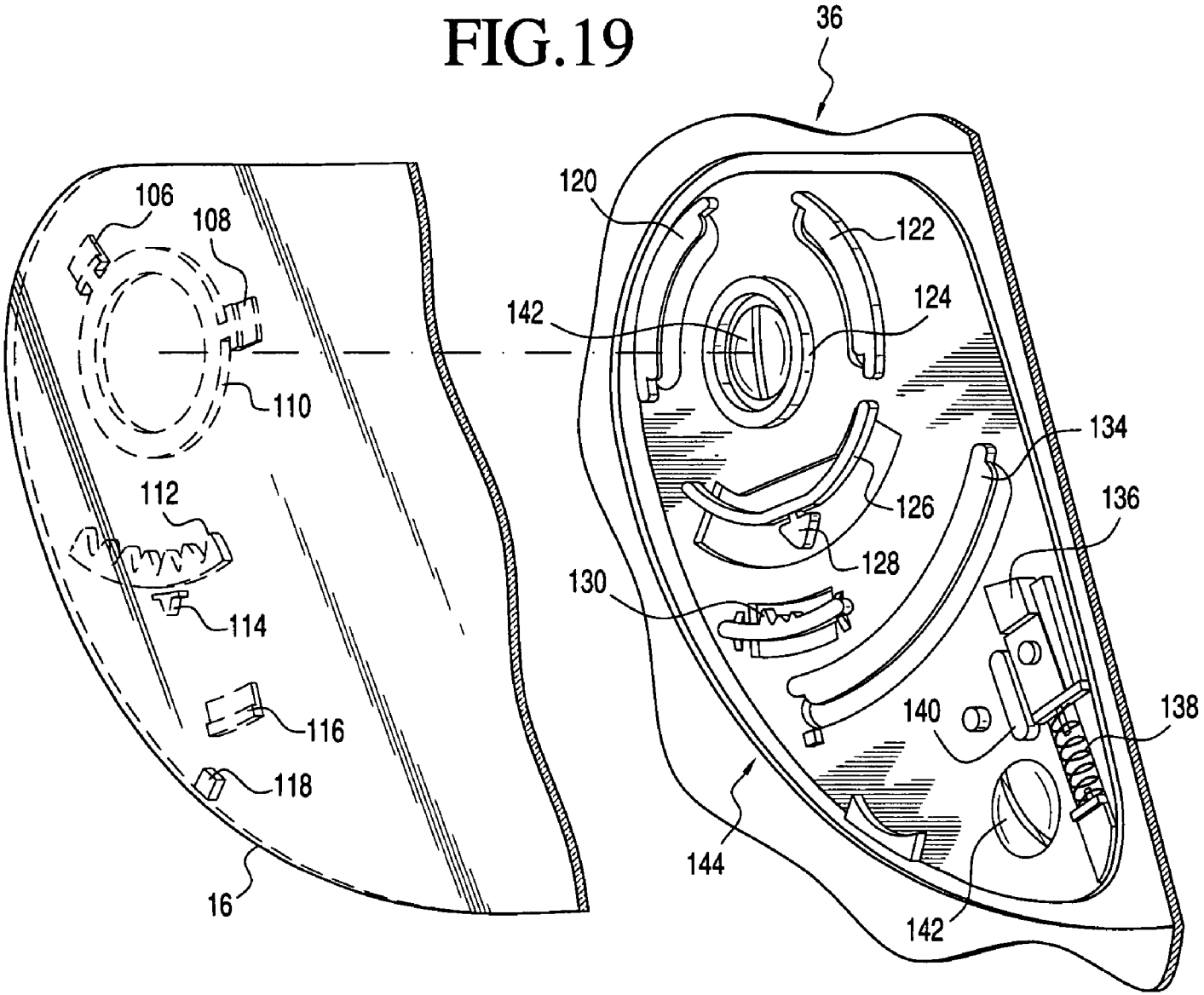
FIG. 19 is a fragmentary exploded view of an exemplary embodiment of a visor hinge in accordance with the present invention.

FIG. 19 is a fragmentary exploded view of an exemplary embodiment of a visor hinge in accordance with the present invention. In particular, a first portion 16 includes a substantially annular protrusion 110, a series of detents 112, a visor detent 114, a guide detent 116, and a stop 118. The chin guard 14 part of the visor hinge includes semi-circular guide rails 120 and 122, an annular protrusion 124 to fit inside the annular protrusion 110 on the visor when assembled, a semicircular protrusion 126 having a detent 128 flexibly attached thereto, a set of detents 130 disposed in a semicircle, a large semicircular guide rail 134, a catch 136, catch guide rails 140, a catch spring 138, and chin guard visor hinge fasteners 142.

Figure 20:
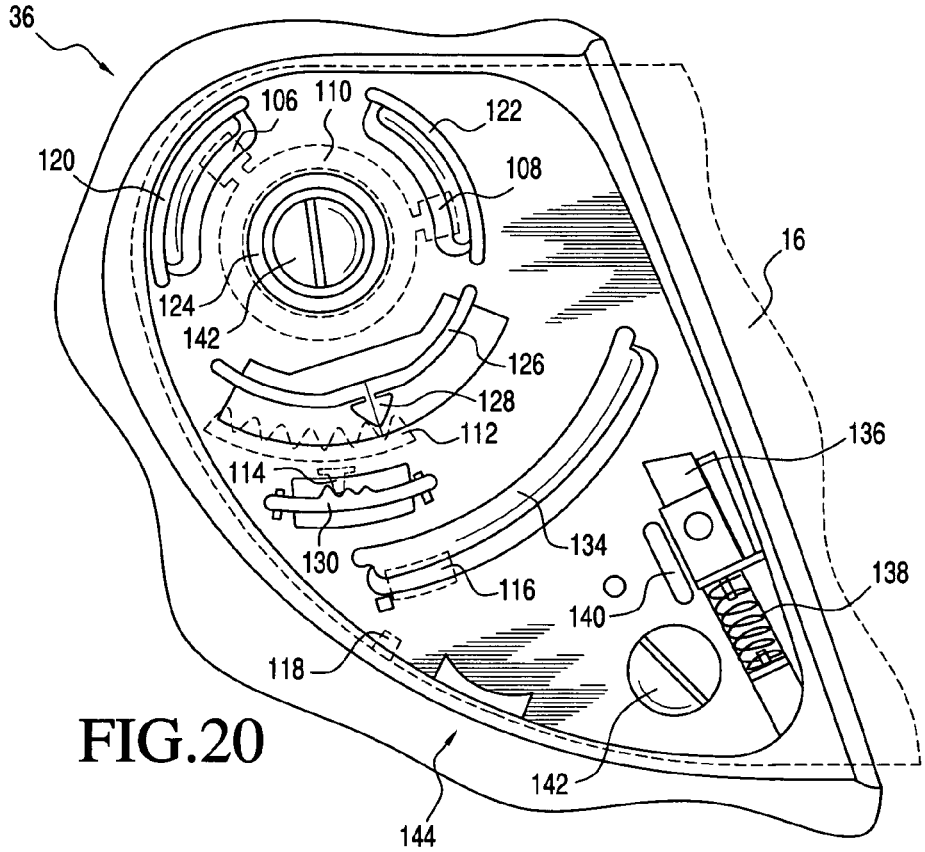
FIG. 20 is a fragmentary view of an exemplary embodiment of a visor hinge in accordance with the present invention, showing the visor in a lowered position.

FIG. 20 is a fragmentary view of an exemplary embodiment of a visor hinge in accordance with the present invention, showing the visor in a lowered position. Specifically, the chin guard detent 128 is engaged with a first detent in the series of detents 112 on the visor 16. The visor detent 114 is engaged with a first detent in the series of detents 130 on the chin guard 14.

Figure 21:
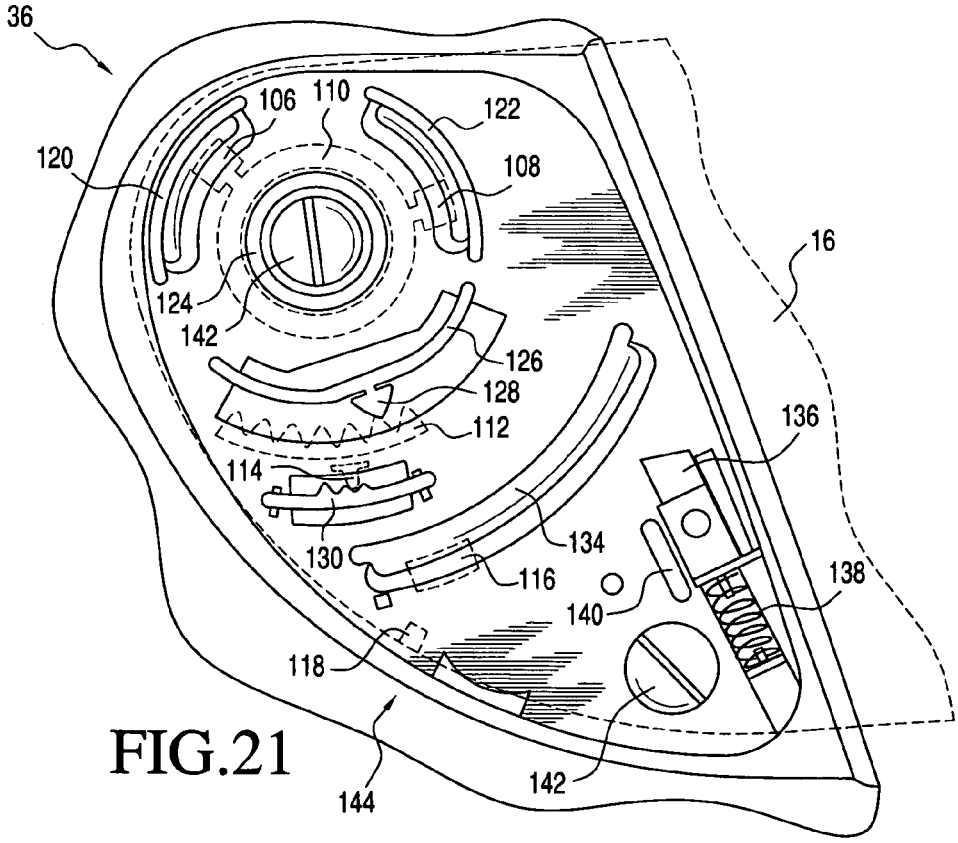
FIG. 21 is a fragmentary view of an exemplary embodiment of a visor hinge in accordance with the present invention, showing the visor in a partially raised position.

FIG. 21 is a fragmentary view of an exemplary embodiment of a visor hinge in accordance with the present invention, showing the visor in a partially raised position. In this position, the chin guard detent 128 has advanced to a location between a first detent and a second detent in the series of detents 112 on the visor 16. The visor detent 114 is now engaged with a second detent in the series of detents 130 on the chin guard 14. Further, the visor guides 106 and 108 have advanced partially around the semicircular guides 120 and 122, respectively, on the chin guard 14. The guide 116 on the visor has advanced in its corresponding guide rail 134.

Figure 22:
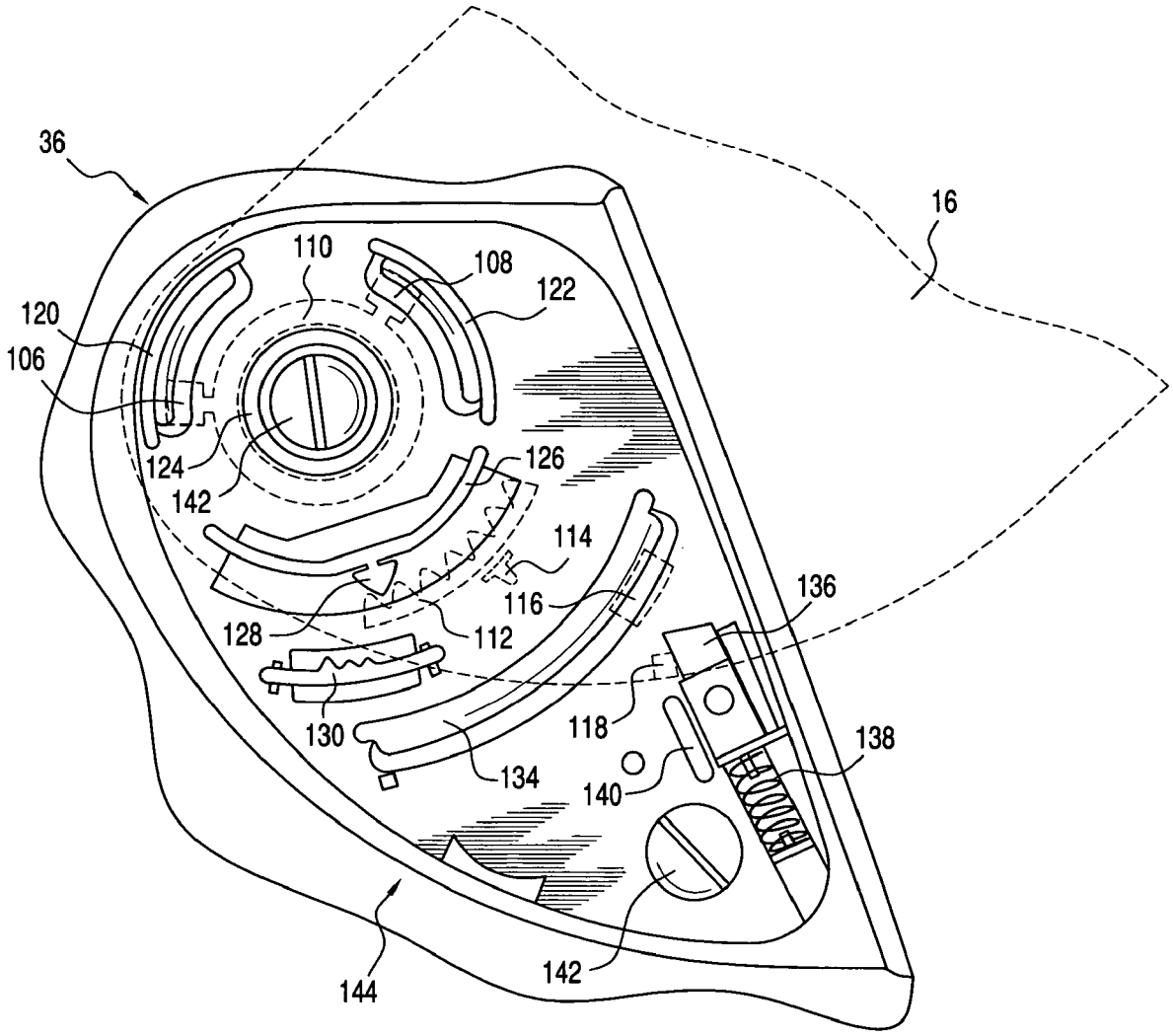
FIG. 22 is a fragmentary view of an exemplary embodiment of a visor hinge in accordance with the present invention, showing the visor in a partially raised position.

FIG. 22 is a fragmentary view of an exemplary embodiment of a visor hinge in accordance with the present invention, showing the visor in a partially raised position. Specifically, in this position, the visor has been raised to the last of the ratchet positions provided by the detents. In this position, the chin guard detent 128 has advanced to a last detent in the series of detents 112 on the visor 16. The visor detent 114 has now moved beyond the series of detents 130 on the chin guard 14. Further, the visor guides 106 and 108 have advanced partially around the semicircular guides 120 and 122, respectively, on the chin guard 14. The guide 116 on the visor has advanced in its corresponding guide rail 134. The stop 118 on the visor is adjacent to the catch 136.

Figure 23:
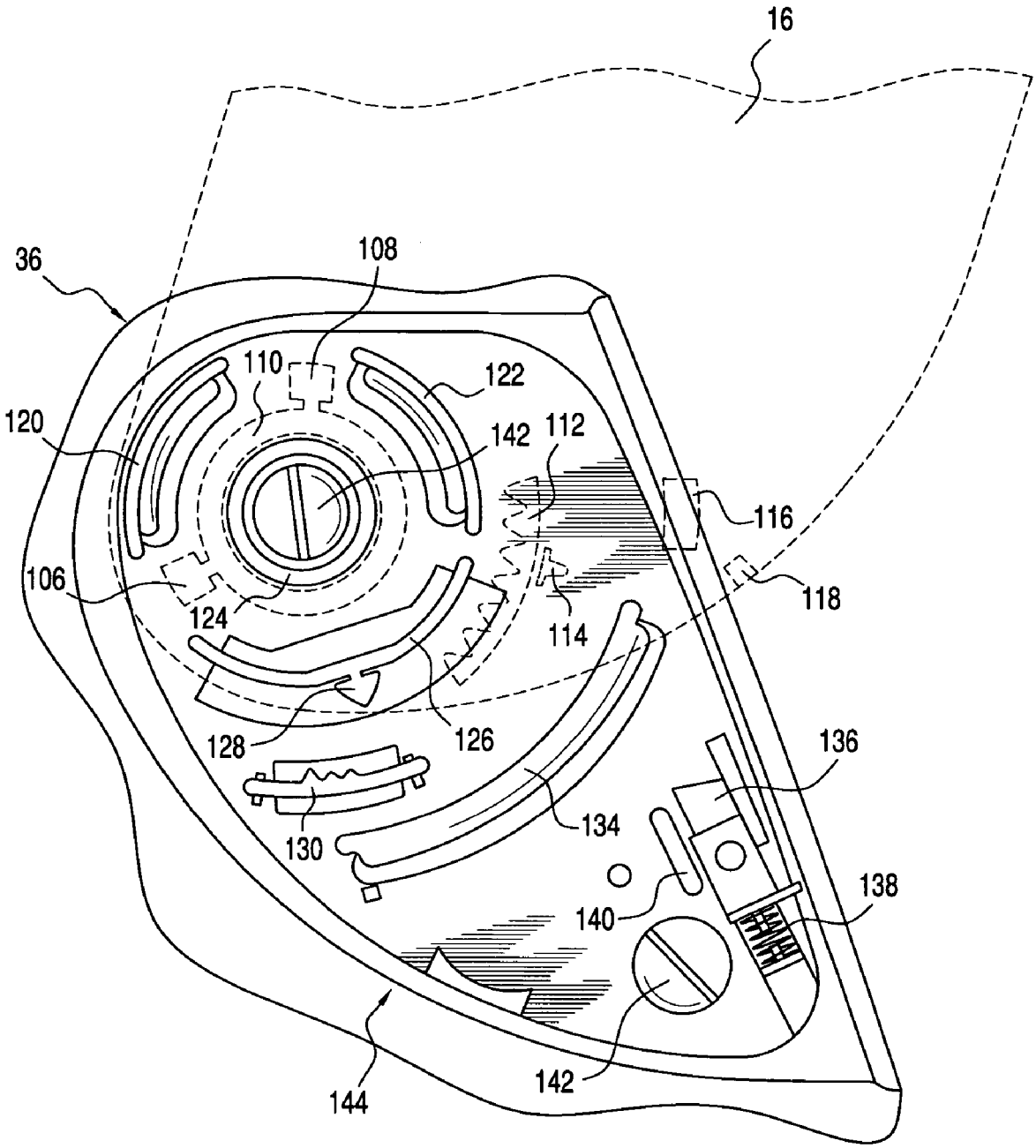
FIG. 23 is a fragmentary view of an exemplary embodiment of a visor hinge in accordance with the present invention, showing the visor in a fully raised position.

FIG. 23 is a fragmentary view of an exemplary embodiment of a visor hinge in accordance with the present invention, showing the visor in a fully raised position. Specifically, in this position, the catch 136 has been retracted by a wearer pulling down on the catch 136 and compressing the spring 138. Thus, allowing the stop 118 to move beyond the catch 136 position. In this fully raised position, the chin guard detent 128 has advanced beyond the series of detents 112 on the visor 16. The visor detent 114 is still beyond the series of detents 130 on the chin guard 14. And the visor guides 106 and 108 have advanced beyond the semicircular guides 120 and 122, respectively, on the chin guard 14. The guide 116 on the visor has advanced beyond its corresponding guide rail 134. Once the visor has advanced to this position, the visor can be removed from the helmet.

Figure 24:
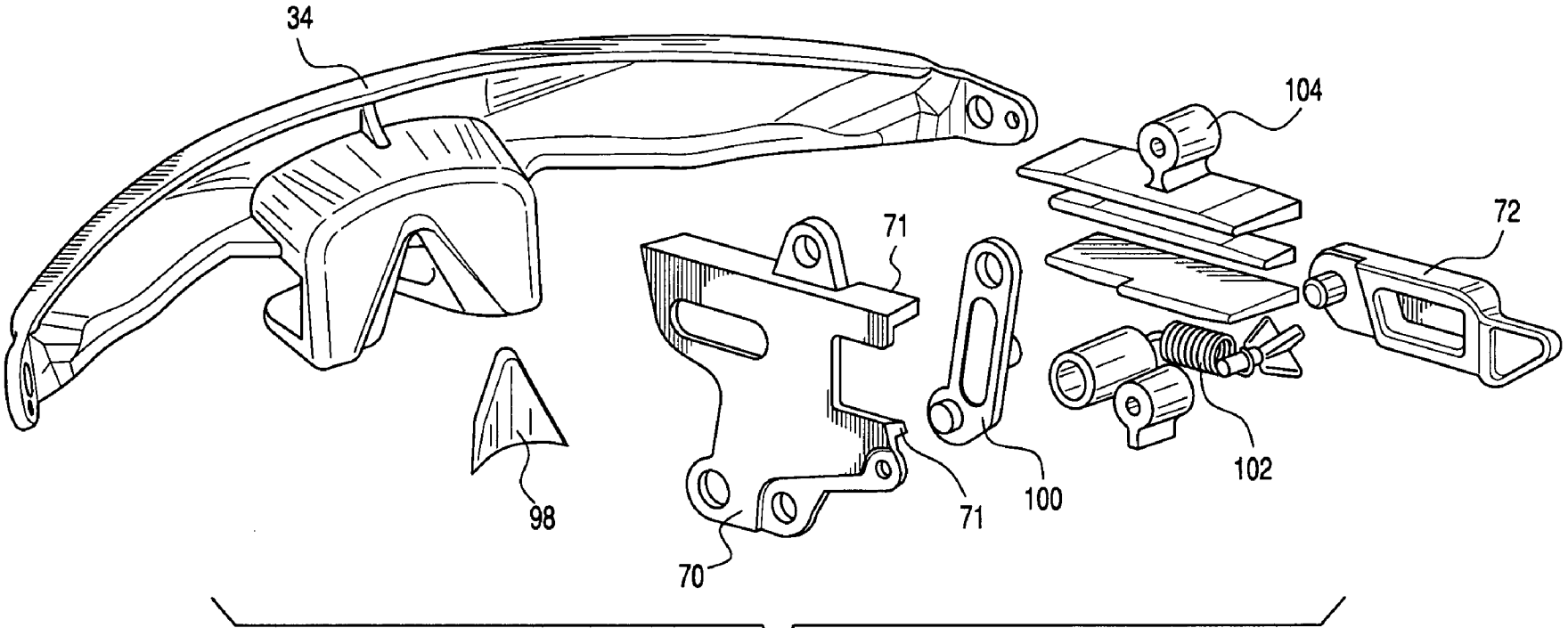
FIG. 24 is an exploded view of an exemplary chin guard lock in accordance with the present invention.

FIG. 24 is an exploded view of an exemplary chin guard lock in accordance with the present invention. In particular, the chin guard actuator 34, the chin guard rubber knob 98, the chin guard lock cap 70, the chin guard lock lever 100, the chin guard lock spring 102, chin guard mounting off features 104, and the chin guard lock hook 72 are shown.

In operation, an exemplary embodiment of the chin guard lock reacts with a motion ration of 2 to 1 in response to the chin guard actuator 34 movement. In other words, if, for example, the chin guard actuator 34 travels 5 mm, the chin guard lock hook 72 will travel 10 mm. The chin guard lock cap 70 includes outer beams 71 disposed on the inside of the chin guard lock cap 70 to provide additional strength to the chin guard lock mechanism. The chin guard lock cap 70 is held in place by fasteners, such as, for example, metal screws.

Figure 25:
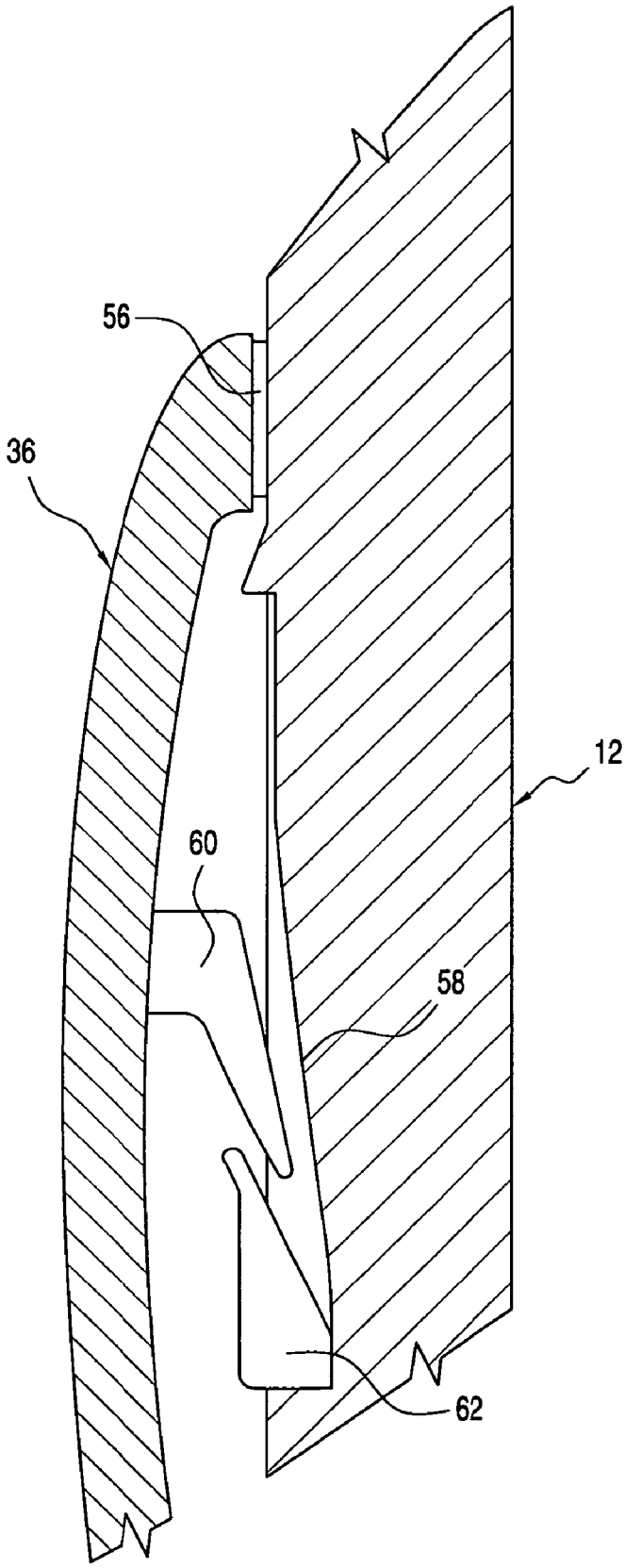
FIG. 25 is an elevational view diagram showing the detail of the interface between the cap body and the chin guard side when the chin guard is in a fully lowered position.

FIG. 25 is an elevational view diagram showing the detail of the interface between the cap body and the chin guard side when the chin guard is in a fully lowered position. Specifically, the chin guard side 36 has attached thereto the lock hook 60. For example, during the final 10° of downward rotation the lock hook 60 engages the hook cap 62 attached to the cap body 12. The engagement of the lock hook 60 and hook cap 62 causes the chin guard side 36 to be pulled toward the cap body and press against the side seal 56 once the chin guard 14 has been fully lowered and locked into place. A travel limiter 57 limits travel of the chin guard 14. The side seal may be a urethane foam pad, or the like. The side seal helps prevents rattling of the chin guard side 36 against the cap body 12 and may also prevent moisture from entering the cap body 12 at the interface of the chin guard side 36 and the cap body 12.

As is apparent from the above description and the figures referenced therein, there is provided a modular helmet with a hinged chin guard and a hinged visor in accordance with the present invention. While this invention has been described in conjunction with a number of embodiments, it is evident that many alternatives, modifications and variations would be, or are, apparent to those of ordinary skill in the applicable arts. Accordingly, applicant intends to embrace all such alternatives, modifications, equivalents and variations that are within the spirit and scope of this invention.

The invention claimed is:

1. A helmet comprising:

a hard outer cap body having a top, a left side, a right side, and a crushable inner liner;

a chin guard having a left and right side, said left and right chin guard sides being pivotally connected respectively to the left and right sides of the cap body by a pair of chin guard hinges; and a recess on each of the left and right sides of the cap body, one each of said pair of hinges being disposed in one of the recesses, and each said hinge including a pair of rotational joints, one of which has a fixed axis and one of which has a floating axis, and a swivel arm coupling the rotational joint of the fixed axis and the rotational joint of the floating axis, wherein each chin guard hinge recess on the cap body includes a raised section configured to cause the hinges to move the left side and right side of the chin guard away from the respective sides of the cap body during rotation of the chin guard and a lower section configured to cause the hinges to secure the chin guard in a fully raised and fully lowered position such that the helmet may be worn with the chin guard in the fully raised or fully lowered position.

2. The helmet of claim 1, further comprising a visor connected to the left and right sides of the chin guard by a visor hinge disposed on each side of the visor and chin guard.

3. The helmet of claim 1, wherein the chin guard is adapted to rotate in an elliptical trajectory about the sides and top of the cap body.

4. A helmet comprising:

a hard outer cap body having a top, a left side, a right side, and a crushable inner liner;

a chin guard having a left and right side, said left and right chin guard sides being pivotally connected respectively to the left and right sides of the cap body by a pair of chin guard hinges; and a recess on each of the left and right sides of the cap body, one each of said pair of hinges being disposed in one of the recesses, and each said hinge including a pair of rotational joints, one of which has a fixed axis and one of which has a floating axis, and a swivel arm coupling the rotational joint of the fixed axis and the rotational joint of the floating axis, wherein the left and right sides of the chin guard each include a hook, and the left and right sides of the cap body each include a track and a hook cap corresponding to the hook on the chin guard side, wherein each hook travels in the corresponding track during chin guard rotation and each hook cap engages the corresponding hook to pull the side of the chin guard toward the cap body when the chin guard is fully lowered.

5. A helmet comprising:

a hard outer cap body having a top, a left side, a right side, and a crushable inner liner;

a chin guard having a left and right side, said left and right side of the chin guard being pivotally connected to the cap body by a pair of chin guard hinges; and a visor, a visor hinge disposed on each side of the visor and chin guard connecting said visor to a corresponding left and right side of the chin guard, said visor hinge including a release mechanism to allow for the removal of the visor from the chin guard, wherein the release mechanism includes a spring-loaded lock on the chin guard which, when retracted, allows the visor to rotate to a position in which the annular protrusions on the visor and chin guard are disengaged and the visor is removable from the chin guard.

6. The helmet of claim 5, wherein the chin guard and the visor are operatively connected to be rotated independently relative to the cap body.

7. A helmet comprising:

a hard outer cap body having a top, a left side, a right side, and a crushable inner liner;

a chin guard having a left and right side, said left and right side of the chin guard being pivotally connected to the cap body by a pair of chin guard hinges; and a visor, a visor hinge disposed on each side of the visor and chin guard connecting said visor to a corresponding left and right side of the chin guard, said visor hinge including a release mechanism to allow for the removal of the visor from the chin guard, wherein each visor hinge comprises:

a visor annular protrusion disposed on an inside surface of the visor adjacent to the chin guard;

a plurality of adjacent detents disposed on the chin guard;

at least one stop protrusion provided adjacent to the visor annular protrusion;

a chin guard annular protrusion disposed on the chin guard to engage the visor annular protrusion on a corresponding visor hinge portion;

at least one guide protrusion having two ends to engage the stop protrusion on the corresponding visor hinge; and a ratchet detent disposed on the chin guard to flexibly engage one or more of the plurality of adjacent detents on the corresponding visor hinge portion such that a ratchet action is provided when the visor is rotated.

8. The helmet of claim 5, further comprising a visor lock to prevent the visor from being raised inadvertently.

9. A helmet comprising:

a hard outer cap body having a top, a left side, a right side, and a crushable inner liner;

a chin guard having a left and right side, said left and right side of the chin guard being pivotally connected to the cap body by a pair of chin guard hinges;

a pair of visor hinges disposed on each side of the visor for connecting left and right sides of the visor to respective left and right sides of the chin guard;

a chin guard lock disposed on each side of the chin guard for mechanically engaging the cap body and through locking the chin guard in a lowered position relative to the top of the cap body, wherein the left and right sides of the chin guard each include a hook, and the left and right sides of the cap body each include a track and a hook cap corresponding to the hook on the chin guard side, wherein each hook travels in the corresponding track during chin guard rotation and each hook cap engages the corresponding hook to pull the side of the chin guard toward the cap body and seal the helmet when the chin guard is fully lowered.

10. The helmet of claim 9, further including a chin guard lock release disposed on an inside surface of the chin guard and configured to be activated by a single button operable to disengage the chin guard lock from the cap body and allow the chin guard to be rotated relative to the cap body.

11. The helmet of claim 9, wherein the chin guard and visor are each adapted to be rotated to an open position independent of the other.

12. The helmet of claim 9, wherein the chin guard lock further includes:

a chin guard lock hook coupled to the chin guard lock lever to engage the cap body to lock the chin guard in a lowered position; and an actuator coupled to the chin guard lock lever adapted to release the chin guard lock.

13. The helmet of claim 9, further comprising a cap body detent on the left side and the right side of the cap body, and a pair of corresponding chin guard lock hooks adapted to engage a corresponding cap body detent to prevent the chin guard from rotating when the chin guard is in a lowered position.

14. A helmet comprising:

a hard outer cap body having a top, a left side, a right side, and a crushable inner liner;

a chin guard having a left and right side, said left and right side of the chin guard being pivotally connected to the cap body by a pair of chin guard hinges;

a pair of visor hinges disposed on each side of the visor for connecting left and right sides of the visor to respective left and right sides of the chin guard;

a chin guard lock disposed on each side of the chin guard for mechanically engaging the cap body and through locking the chin guard in a lowered position relative to the top of the cap body, wherein each visor hinge comprises:

a visor annular protrusion disposed on an inside surface of the visor adjacent to the chin guard;

a plurality of adjacent detents disposed on the chin guard;

at least one stop protrusion provided adjacent to the visor annular protrusion;

a chin guard annular protrusion disposed on the chin guard to engage the visor annular protrusion on a corresponding visor hinge portion;

at least one guide protrusion having two ends to engage the stop protrusion on the corresponding visor hinge; and a ratchet detent disposed on the chin guard to flexibly engage one or more of the plurality of adjacent detents on the corresponding visor hinge portion such that a ratchet action is provided when the visor is rotated between a closed and an open position.

15. A helmet comprising:

a cap body having a left side, a right side, a top and a back;

a chin guard having a left side and a right side;

a first pair of hinges for pivotally attaching the chin guard to the left side and right side of the cap body;

a visor; and a second pair of hinges for pivotally attaching the visor to the right side and left side of the chin guard, whereby said chin guard and said visor are selectively locked and are operable to rotate independently of each other, wherein the left and right sides of the chin guard each include a hook, and the left and right sides of the cap body each include a track and a hook cap corresponding to the hook on the chin guard side, wherein each hook travels in the corresponding track during chin guard rotation and each hook cap engages the corresponding hook to pull the side of the chin guard toward the cap body and seal the helmet when the chin guard is fully lowered.

16. The helmet of claim 15, wherein the chin guard and visor can each be rotated independently relative to the cap body.

17. The helmet of claim 15, further comprising a chin guard lock having a single button release actuator disposed in an inside surface of the chin guard.

18. The helmet of claim 15, wherein the chin guard hinges include a floating axis joint coupled to a fixed axis joint by a swing arm disposed in a contoured recess in the cap body, such that the chin guard is raised in an elliptical path and the left and right sides of the chin guard are extended outwardly relative to the cap body during the chin guard rotation.

19. The helmet of claim 4, further comprising a visor connected to the left and right sides of the chin guard by a visor hinge disposed on each side of the visor and chin guard.

20. The helmet of claim 4, wherein the chin guard is adapted to rotate in an elliptical trajectory about the sides and top of the cap body.

21. The helmet of claim 7, wherein the chin guard and the visor are operatively connected to be rotated independently relative to the cap body.

22. The helmet of claim 7, further comprising a visor lock to prevent the visor from being raised inadvertently.

23. The helmet of claim 14, further including a chin guard lock release disposed on an inside surface of the chin guard and configured to be activated by a single button operable to disengage the chin guard lock from the cap body and allow the chin guard to be rotated relative to the cap body.

24. The helmet of claim 14, wherein the chin guard and visor are each adapted to be rotated to an open position independent of the other.

25. The helmet of claim 14, wherein the chin guard lock further includes:

a chin guard lock hook coupled to the chin guard lock lever to engage the cap body to lock the chin guard in a lowered position; and an actuator coupled to the chin guard lock lever adapted to release the chin guard lock.

26. The helmet of claim 14, further comprising a cap body detent on the left side and the right side of the cap body, and a pair of corresponding chin guard lock hooks adapted to engage a corresponding cap body detent to prevent the chin guard from rotating when the chin guard is in a lowered position.

* * * * *